US008561530B2

(12) United States Patent
Imai

(10) Patent No.: US 8,561,530 B2
(45) Date of Patent: Oct. 22, 2013

(54) WIRE BOBBIN BINDING DEVICE AND AUTOMATIC BOBBIN WINDING DEVICE USING WIRE BOBBIN BINDING DEVICE

(75) Inventor: Koichi Imai, Ohtawara (JP)

(73) Assignee: Imai Machine Works, Inc., Ohtawara-shi, Tochigi-Ken (JP)

( * ) Notice: Subject to any disclaimer, the term of this patent is extended or adjusted under 35 U.S.C. 154(b) by 366 days.

(21) Appl. No.: 12/969,555

(22) Filed: Dec. 15, 2010

(65) Prior Publication Data

US 2011/0309183 A1 Dec. 22, 2011

(30) Foreign Application Priority Data

Dec. 22, 2009 (JP) ..... 2009-290478

(51) Int. Cl.
*B65B 13/10* (2006.01)
*B65H 65/00* (2006.01)

(52) U.S. Cl.
USPC ..... 100/15; 100/5; 100/27; 242/473.8

(58) Field of Classification Search
USPC ..... 100/5, 6, 15, 27, 31; 242/362.1, 362.2, 242/172, 475.7, 580, 473.8
See application file for complete search history.

(56) References Cited

U.S. PATENT DOCUMENTS 2,862,442 A * 12/1958 Jones ..... 100/27
4,079,565 A * 3/1978 Lancaster et al. ..... 53/397
6,513,745 B1 * 2/2003 Suter et al. ..... 242/362.2

FOREIGN PATENT DOCUMENTS

JP 04239418 A * 8/1992
JP 1995-223771 A 8/1995

* cited by examiner

*Primary Examiner* — Jimmy T Nguyen

(57) ABSTRACT

A wire bobbin binding device includes a binding head having first and second coaxially aligned rotatably mounted chucks for engaging opposite sides of an empty bobbin for motor-driven rotation about a bobbin axis while a wire is wound upon the bobbin. A ring creeping clip is mounted on the binding head and moveable between an advanced position and a retracted position to selectively engage the wire and bind the terminal end of the wire.

9 Claims, 18 Drawing Sheets

WIRE BOBBIN BINDING DEVICE AND AUTOMATIC BOBBIN WINDING DEVICE USING WIRE BOBBIN BINDING DEVICE

BACKGROUND OF INVENTION

1. Field of the Invention

This invention relates to a device for binding a wire such as a steel wire wound around a bobbin and an automatic winding device for winding a wire to a bobbin using the binding device.

2. Description of Related Art

A pressure-proof tube made of rubber or resin of which strength is increased by knitting fine steel wires is used in a hydraulic device or a compressor and the like in order to feed out fluid under a high pressure. The steel wire used when such a pressure-proof tube is manufactured is shipped out of a steel wire manufacturing factory under a state in which it is wound around a large-sized drum, so that the wire is rewound around an exclusive bobbin of the pressure-proof tube manufacturing device. This rewinding work is carried out mechanically at the bobbin winding device.

In the case of usual processing, the drums having a steel wire transported from a steel wire manufacturing factory and wound around them are once installed at a supply reel stand together with a requisite number of steel wires wound around the bobbin, the steel wires drawn out of each of the drums are once set into one bundle, supplied to the bobbin winding device, the bundle of steel wires is wound by the bobbin winding device into a predetermined length for every bobbin and then the rewinding operation is finished.

In the prior art, as such a steel wire winding device, there has been used a turn-table type steel wire winding device enabling an efficient winding-up of wires to be carried out by feeding several bobbins simultaneously to the turn table in sequence.

However, although supplying of a vacant bobbin to the device or winding of the steel wire onto a bobbin in the turn-table type device could be carried out mechanically, the extended end of the wire freely deformed to show a substantial violent action, so that its initial fixing or its final binding against the bobbin could not be performed automatically with machine and so it was quite difficult to provide a device capable of performing all the wire winding operations to the bobbin only with a machine (a full automatic bobbin winding device).

In turn, a Patent Document 1 described below has provided "a wire winding device" enabling a full-automatic winding operation of the wire to be carried out without any operator for winding up the wire on "a winding frame" after setting the wire to the "winding frame" on the turn-table.

However, this device enables a non-stop continuous wire winding operation (a full-automatic operation) to be carried out through usage of a special "winding frame", so that even if this "winding frame" is tried to be fully operated automatically in place of the aforesaid "exclusive bobbin", the winding-finished steel wire cannot be bound to "the bobbin" because of a quite different structure between "the winding frame" and its bobbin, resulting in that a full-automatic operation of the entire device cannot be carried out.

[Patent Document 1] Japanese Unexamined Patent Publication 1995-223771

Although realization of a full-automatic device for wire winding to a bobbin remarkably improved a production efficiency to enable a substantial cost-down to be attained, a winding operation such as a binding operation or the like in the prior art device frequently performed for every bobbin could not eliminate the manual operation as described above.

Due to this fact, it has been strongly required up to now to realize the bobbin automatic binding device enabling a full-automatic winding operation for a wire to the bobbin to be realized.

DISCLOSURE OF INVENTION

In view of the foregoing, it is an object of the present invention to provide a wire binding device in which all the terminal ends of the wires such as steel wires wound around each of the bobbins can be bound strongly in a mechanical manner without performing any manual operation and additionally it is an object of the present invention to provide a bobbin automatic winding device for wires in which the works ranging from a winding to a binding of the wires supplied to the bobbin can be carried out automatically in a continuous manner without accompanying any manual work under application of the wire binding device.

To achieve the above object, this invention provides the wire bobbin binding device in which a disc-like binding head having its rotational central direction crossed at a right angle with a front surface of a plane-like upright base plate is rotatably arranged at said front side surface side of the base plate by a motor arranged at a rear surface side of said substrate, one bobbin chuck of both bobbin chucks opposing to enable the bobbin to be held is rotatably arranged at a central front surface of said binding head to a rotating direction opposite to a rotating direction of said binding head at a rotational center in common with a rotational center of said binding head by a motor arranged at a rear surface of said base plate, a chuck base table is arranged in front of said base plate, the other bobbin chuck opposing against the bobbin chuck of said binding head is caused to protrude or retreat at the upper part of said chuck base table under an operation of a chuck cylinder arranged at the rear side toward the bobbin chuck of said binding head so as to hold the bobbin and rotatably arranged to be driven in response to a rotation of said held bobbin, wire guide pieces for guiding said wire to a part before the bobbin at the side of the wire supplied to a bobbin near the bobbin held by said bobbin chuck and a wire cutter reciprocatable by a cylinder from a spaced-apart position up to a position where it can reach the wire tensioned between said bobbin and said wire guide pieces are arranged at said base plate, the bobbin finished for winding the supplied wire is held by said bobbin chuck, a ring creeping clip protruded at a location of the chuck surface of said binding head not contacted with the bobbin while rotating said binding head by each of said motors is operated to protrude or retreat by a cylinder arranged at a rear side of said chuck surface, said wire is bound at the bobbin winding terminal end, the terminal end of the binding portion of said wire is cut, made to be independent and can be discharged, wherein said ring creeping clip can hold and release said wire guided by said wire guide pieces between an central engaging part and its outer engaging/holding part while the engaging part protrudes or retreats from its outside engaging/holding part under an operation of a cylinder arranged at a rear side, provided with a wire outer-engaged inner cylinder having a length capable of engaging said wire when it is protruded at an outer periphery of the engaging/holding part under an operation of the cylinder provided at the rear side and a wire pushing-out outer cylinder arranged at the outer periphery of said wire outer-engaged inner cylinder and enabling its extremity end to protrude or retreat from the extremity end of said wire outer-engaged inner cylinder to its tip end, said binding head is rotated, the end part of the wire reversely wound at said bobbin is engaged with said engaging part in the ring of the wire engaged in a ring manner at the wire outer-engaged inner cylinder of said ring creeping clip and drawn out under an operation of the cylinder arranged at the rear side, the ring part engaged with said wire outer-engaged inner cylinder is dropped off the outside of said engaging part to cause the end part of the wire fixed by said engaging part to be dived into the ring part, and further said binding head is rotated to cause the end part of the wire dived into said ring part to be pulled and squeezed by said engaging part, both drawing and squeezing portions of said wire are bent and deformed and can be wound not to be pulled out of said ring part.

In the invention as defined in claim 2, it is characterized in that a wire pushing/releasing claw protruded or retreated to enable the wire engaged with the extremity end of said ring creeping clip to be pushed and released under an operation of the cylinder provided at the rear side is arranged near the ring creeping clip at the surface side of the base plate.

In the invention as defined in claim 3, the wire bobbin binding device is characterized in that the stick surface is arranged in at least an upper or lower oscillation range of the wire between the bobbin held by the bobbin chucks and the wire guide piece, the wire pushing/moving stick that can be forwarded or retarded in parallel to a direction of rotary axis of the bobbin along the bobbin under an operation of the cylinder arranged at the rear side is arranged in such a way that it can be pushed and moved to a position where the wire is engaged with the wire outer-engaged inner cylinder and a position where the wire is engaged with the engaging part of the ring creeping clip.

In the invention as defined in claim 4, the automatic bobbin winding device is characterized in that a supplying side of a vacant bobbin before winding at a surface side of the base plate in common with said binding device is provided with a disc-like winding head having a rotary center direction crossed at a right angle with the surface of said base plate in a rotatable manner by the motor arranged at the rear surface of said base plate and at the same time the central front side of said winding head is provided with one bobbin chuck of both opposed bobbin chucks to enable the bobbin to be held at an axial center in common with the rotary axis of said winding head, a chuck base table is arranged in front of said base plate, the upper part of said chuck base table is provided with the other bobbin chuck opposing against the bobbin chuck of said winding head that is caused to protrude or retreat under an operation of the chuck cylinder arranged at the rear side toward the bobbin chuck of said winding head to hold the bobbin and arranged to be rotatable in response to a rotation of said held bobbin, a location of the chuck surface of said winding head not contacted with the bobbin is provided with a engaging clip having an engaging part for engaging with a middle part of the wire at its extremity end to cause said engaging part to protrude or retreat by reciprocating a pushing-out part arranged at the rear side of the chuck surface of said winding head under an operation of the cylinder installed at the rear side of said base plate to enable the wire to be held, a guide beak installed on a traverse table to enable the wire on a rotating bobbin to be wound in an arranged row while guiding the wire to an axial direction of the bobbin held by the bobbin chucks of said winding head and reciprocating it is arranged at the wire supplying side of said base plate rather than at a position of said winding head, the winding device for the wire wound on the bobbin according to any one of claims 1 to 3 is arranged at a discharging side of the bobbin after winding the wire, a bobbin lift reciprocatable to a vertical direction under an operation of a bobbin lift cylinder arranged at a lower side is installed through the bobbin transfer table on a lift table arranged below said chuck base table and at the same time said bobbin transfer table enables the bobbin lift to be reciprocated between said winding head and the binding head by a shaft of a lift reciprocating cylinder that can be reciprocated in parallel with the surface side of said base plate to a horizontal direction, and the wire supplied from the guide beak to the bobbin supplied to said winding head and binding head by the bobbin lift is wound and bound, the bobbin is cut from the wire at the supplying side and can be discharged.

In the invention as defined in claim 5, the automatic bobbin winding device is characterized in that the pushing-out plate is formed into a fine arc shape within a range abutted against the pushing-out part of the engaging clip around the winding head by a range of 90° ranging from the upper-most part to the wire binding device side, and said wire engaging clip can push the pushing-out part of the engaging clip by said pushing-out plate at a position ranging from the upper part of the winding head to the binding device.

In the invention as defined in claim 6, the automatic bobbin winding device is characterized in that there are provided two bobbin lifts arranged at the bobbin transfer table, said two bobbin lifts are arranged under an interval corresponding to positions of the winding head and binding head, and the bobbin lift at said binding head side can be reciprocated between one position just below said winding head and the other position just below said binding head.

In the invention as defined in claim 7, the automatic bobbin winding device is characterized in that the bobbin discharging guide plate formed under a descending gradient from a position just below the bobbin held by the bobbin chucks of the binding head toward a discharging direction is arranged to be movable up to a position where it may not be contacted with the moving bobbin lift, and the bound and cut-away bobbin removed from the bobbin chuck of said binding head can be received from below and discharged.

The wire bobbin binding device of this invention is operated such that a rotation of the binding head provided with a ring creeping clip and a rotation of bobbin chucks arranged at the binding head are operated to opposite direction from each other and that a terminal end portion of the wire wound around the bobbin can all be bound under a mechanical operation without having any manual operation at all.

The invention claimed in claim 2 can prevent an accident in which the wire tangles with the ring creeping clip and is not be released from the ring creeping clip because the wire can be dropped positively from the engaging part of the ring creeping clip by the wire pushing/removing claw, and it becomes possible to eliminate a stopping in operation of the device caused by a tangling accident of the cut terminal portion of the wire against the surroundings.

The invention claimed in claim 3 is operated such that the wire guide pieces push and move the wire with the pushing/moving stick to enable the wire to be accurately guided to the wire outer-engaged inner cylinder of the ring creeping clip and its engaging part.

The automatic wire bobbin winding device using the binding device claimed in claim 4 is operated such that application of the aforesaid binding device enables many bobbins to be wound by the binding head in a continuous and automatic manner, the bobbin having the wire wound around it is bound by a subsequent binding head to enable its operation to be carried out mechanically without applying any manual operation in a continuous and automatic manner, resulting in that each of the bobbins after being bound respectively can be discharged out of the device independently.

Due to this arrangement, it becomes possible to execute an operation of the full-automatic device used for binding wire to a bobbin and its production efficiency can be remarkably improved and a substantial cost-down can be achieved as compared with that of the device requiring a manual operation for the conventional binding operation.

Capability of binding of a wire to a bobbin without any manual operation provides some quite substantial effects such as an unmanned factory and a non-stop continuous operation that have not been attained in the prior art.

The invention claimed in claim 5 is operated such that the aforesaid engaging clip can push the pushing-out part of the aforesaid engaging clip with a pushing-out plate also at the binding device by the fine elongated arc pushing-out plate in a range of about 90° around the center of the aforesaid winding head, so that it becomes possible to fix the wire to the engaging part of the engaging clip before cutting of the wire with the wire cutter. Due to this fact, the engaging work of the wire against the engaging part with a robot arm and the like newly required for every operation can be eliminated and correspondingly the winding work of the wire against the bobbin can be performed smoothly, continuously and automatically.

The invention claimed in claim 6 is operated such that the two bobbins can be set simultaneously to the winding head and the binding head, so that an efficiency of the bobbin winding operation can be increased.

The invention claimed in claim 7 is operated such that its operation is switched to a subsequent stage such as a transferring stage for a shipping work after completion of the bobbin winding work.

DESCRIPTION OF PREFERRED EMBODIMENTS

Figure 1:
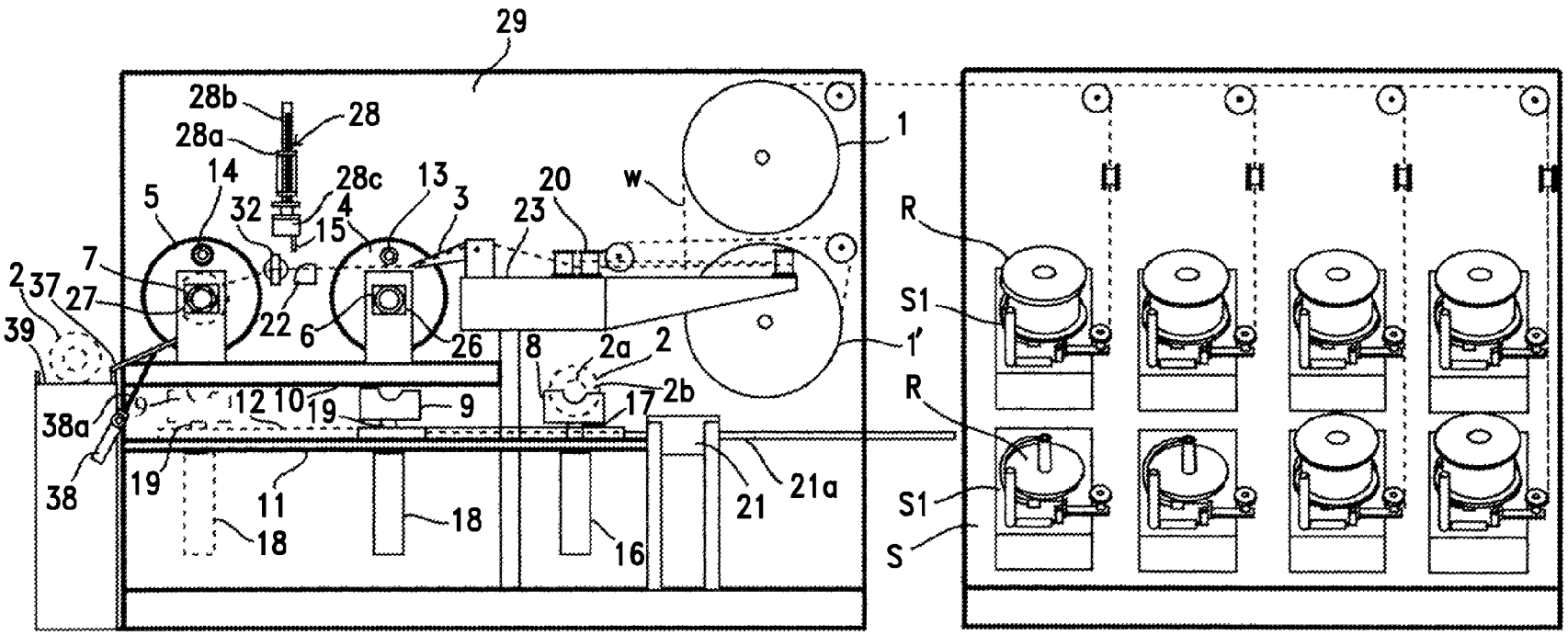
FIG. 1 is a front view showing the supply reel stand and the automatic bobbin winding device of the present invention.

Referring now to the drawings, a mode for executing the wire bobbin binding device and the automatic bobbin winding device using the wire bobbin binding device of the present invention will be described as follows.

The present invention is applied for usage of winding the wire onto the bobbin. Winding the wire onto the bobbin is also used when the wire is a steel wire. For example, in the factory manufacturing a pressure-proof tube by knitting fine steel wires woven there, etc. is used and the like for feeding out fluid under a high pressure water, oil and air and the like to a pressurizing device and the tile, the steel wire binding around a large-sized drum and reel, shipped out of a steel wire manufacturing factory is rewound onto an exclusive bobbin and is used.

The present invention is a device used for automatically winding a metallic wire such as a steel wire onto a bobbin, and the device will be described in detail in reference to an example using the steel wire as the wire.

As shown in FIG. 1, the steel wire W supplied to the device of the present invention is wound onto the reels R, several reels R are simultaneously loaded onto a supply reel stand S in response to the number of knitting wires, and each of the wires is stably fed and supplied from these reels as one bundle of each of the wires to the bobbin installed at the automatic bobbin winding device of the present invention through upper and lower two large-diameter measuring rolls 1, 1' and a small-sized adjustment roll 20 arranged at the front surface side of the adjoining base plate 29.

Figure 2:
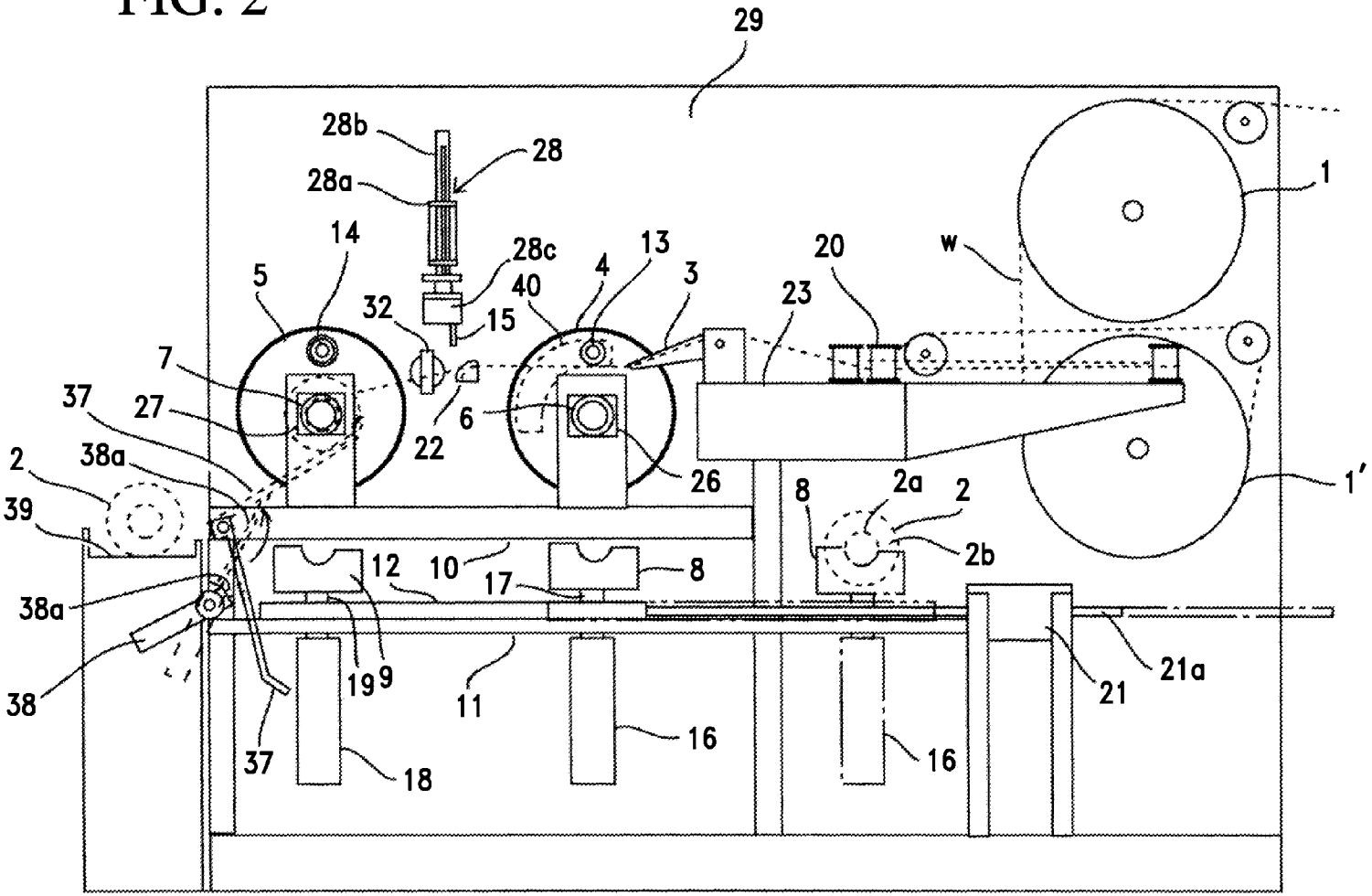
FIG. 2 is a front view showing the automatic bobbin winding device of the present invention.
Figure 4:
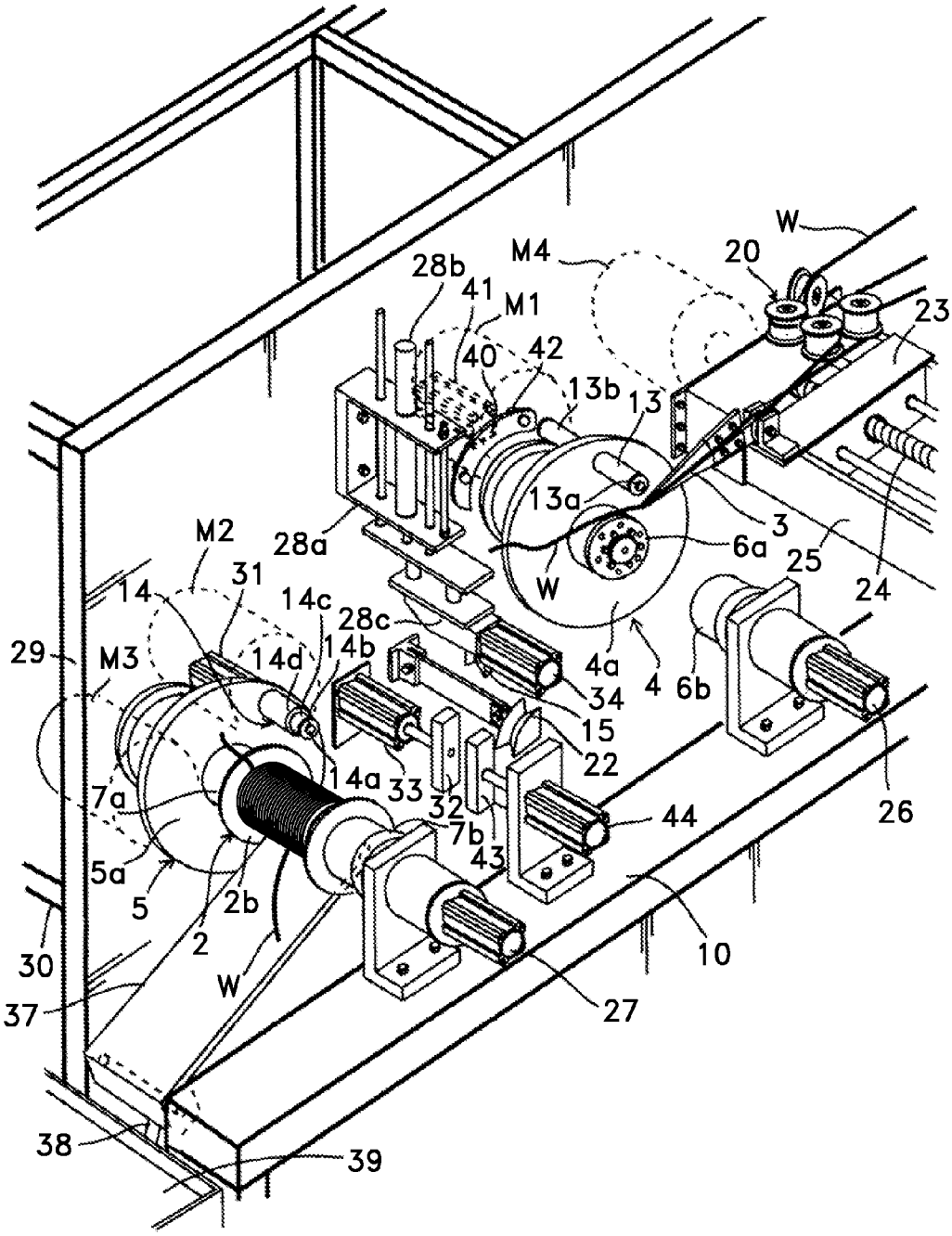
FIG. 4 is a perspective view for showing the automatic bobbin winding device of the present invention.

As shown in FIG. 2 and FIG. 4, the automatic bobbin winding device of the present invention is constituted such that a vacant bobbin 2 before winding is installed at the front surface side of a plane-like upright base plate 29, a disc-like winding head 4 having a center of rotation crossed at a right angle is installed at a supplying side of the wire W (the right side in FIG. 4), a winding head motor M1 for rotating the winding head is installed at the rear surface side of the base plate 29 and at the same time one bobbin chuck 6*a* of both bobbin chucks 6 opposing against to each other in such a way that the bobbin 2 can be held is arranged at the central front side of the winding head 4 is installed in such a manner that its rotational center may become in common with the rotational center of the winding head 4.

Then, a chuck base table 10 is spaced apart from the surface of the base plate 29 by about a distance having a length of the bobbin 2 added to the winding head 4 and arranged at the substantial same height position as that up to the lower part of the winding head 4, spaced apart from the surface of the base plate 29 by about a distance having a length of the bobbin 2 added to the winding head 4 and at the substantial same height position as that up to the lower part of the winding head 4. The other bobbin chuck 6*b* opposing against the bobbin chuck 6*a* of the winding head 4 protrudes or retreats at the upper part of the chuck base table 10 under an operation of the chuck cylinder 26 arranged at the rear part toward the bobbin chuck 6*a* of the winding head 4 so as to hold the bobbin 2 and further arranged in such a way that it can be driven to rotate in response to the rotation of the held bobbin 2.

Figure 6:
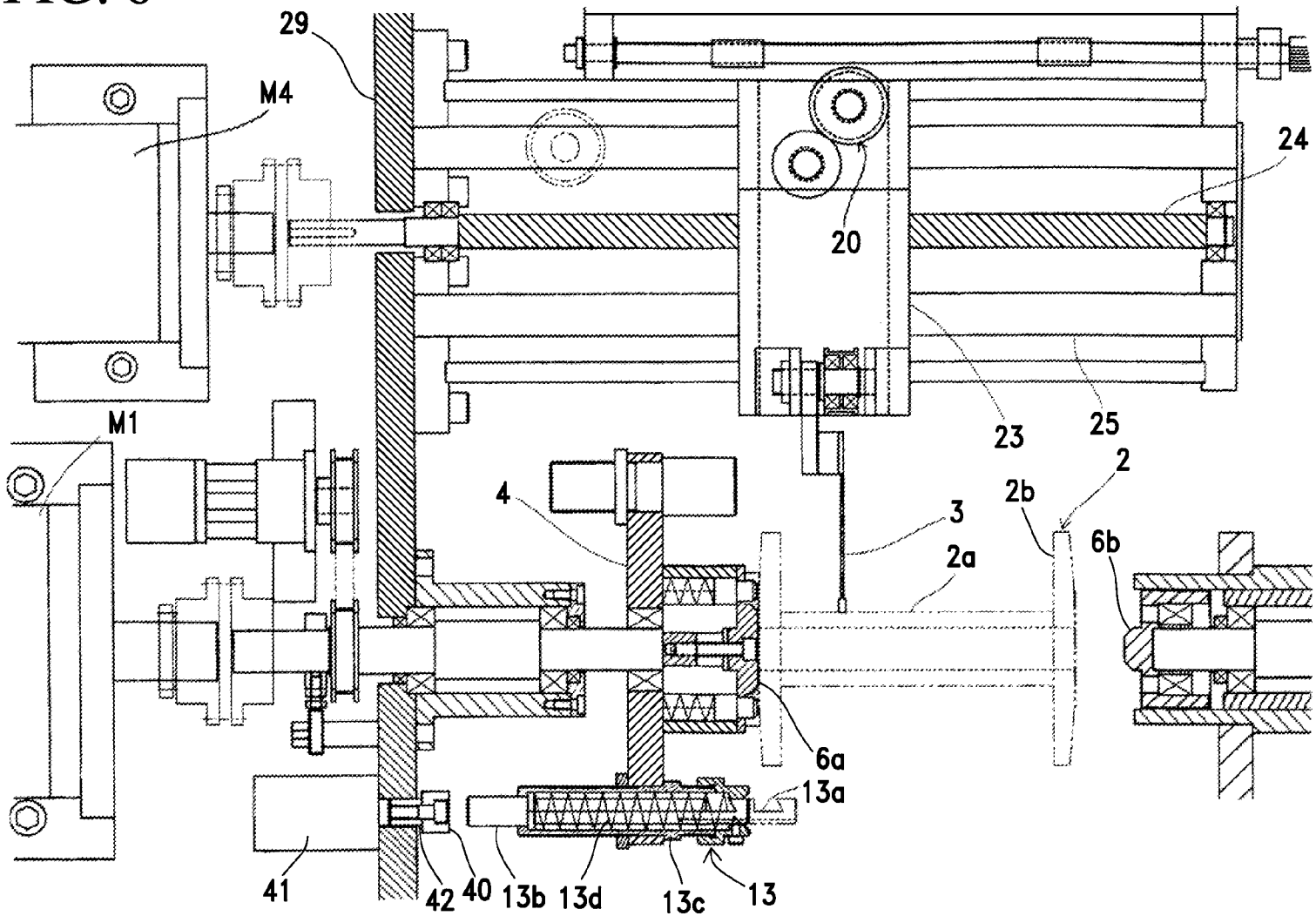
FIG. 6 is a plan view in cross section showing a substantial part of a peripheral portion of the winding head.

In addition, as shown in FIG. 4 and FIG. 6, there is provided a guide beak 3 adjacent to a shaft 2*a* of the bobbin 2 held by the bobbin chuck 6 of the winding head 4 at the supplying side of the wire W from the winding head 4.

As shown in FIG. 4, this guide beak 3 is arranged on a traverse 23 movable in parallel with the bobbin axis by the ball screw 24 of a traverse table 25 protruded at the position of the wire W supplying side rather than that of the winding head 4 at the front surface side of the base plate 29 toward the bobbin chuck 6 of the winding head 4.

The ball screw 24 can be rotated by the traverse motor M4 installed at the rear side of the base plate.

Then, when the winding head 4 is rotated under an operation of the winding head motor M1 having the bobbin 2 arranged at the rear side of the base plate while the traverse 23 is being reciprocated under a control of the traverse motor M4, the wire W fixed to the bobbin 2 is wound up under its row regulated manner.

Operation of the winding head motor M1 and the traverse motor M4 is executed under a control of an electronic circuit installed at another control panel (not shown), while a rotation of the winding head 4 and a reciprocating action of the traverse 23 are set.

Then, as shown in FIG. 4 and FIG. 6, the chuck surface at the front surface of the winding head 4 is protruded, at a location not contacted with the bobbin held by the bobbin chuck 6*a*, with an engaging clip 13 having an engaging part 13*a* for engaging with and fixing a middle part of the wire W at its extremity end, operating to cause the engaging part 13*a* to protrude or retreat by reciprocating the pushing-out part 13*b* arranged at the rear side of the chuck surface of the winding head 4 and to enable the wire W to be held at the engaging part 13*a*.

Then, as shown in FIG. 6, the engaging clip 13 is arranged such that a pushing-out part 13*b* is installed inside a cylinder 13*c* in a sliding reciprocatable manner and an engaging part 13*a* provided with a hook groove for use in engaging with the wire W at the extremity end of the pushing-out part 13*b* can protrude or retreat at the extremity end of the cylinder 13*c*. Then, a coil spring 13*d* is present between the pushing-out part 13*b* and the cylinder 13*c* and the engaging part 13*a* is biased by the coil spring 13*d* in such a way that it may retreat from the extremity end of the cylinder 13*c*.

As shown in FIG. 4 and FIG. 6, the reciprocating motion of the pushing-out part 13*b* causes a pushing-out shaft 42 passing through the base plate 29 of a clip pushing/moving cylinder 41 arranged at a rear surface of the base plate 29 to protrude or retreat, reciprocates a pushing-out plate 40 fixed at the extremity end of the pushing-out shaft 42 protruded at the front surface side of the base plate 29, the pushing-out plate 40 pushes the pushing-out part 13*b* of the engaging clip 13 to enable the engaging part 13*a* of the engaging clip 13 to be pushed out.

That is, the engaging clip 13 is operated such that when the pushing-out part 13*b* is pushed through an advancing action by a clip pushing/moving cylinder 41 of the pushing-out plate 40, the engaging part 13*a* at the extremity end of the pushing-out part 13*b* protrudes from inside of the cylinder 13*c*, and in this case, when the wire W is engaged with the hook groove, retreating of the pushing-out plate 40 caused by the clip pushing/moving cylinder 41 causes the pushing-out part 13*b* to be retreated under biasing of the coil spring 13*d* and the engaging part 13*a* sinks into the cylinder 13*c* to enable the wire W to be engaged with the extremity end of the engaging clip 13.

The engaging clip 13 causes its extremity end to become lower than a flange part 2*b* of a bobbin 2 held by the bobbin chuck 6 when the engaging part 13*a* biased by the coil spring 13*d* retreats from the extremity end of the cylinder 13*c* to prevent it from being contacted with the wire W when the wire W is wound around the bobbin 2. A reason why this state occurs consists in the fact that if it is higher than the flange part 2*b*, the wire tangles around the engaging clip 13 and the bobbin 2 and a normal winding of the wire around the bobbin 2 cannot be carried out.

In addition, although FIG. 4 illustrates the pushing-out plate 40 where its shape is a fine elongated arc one in a range of 90° around the winding head 4.

The pushing-out part 13*b* of the engaging clip 13 can be pushed by the pushing-out plate 40 even if the engaging clip 13 is placed at the binding device and the wire W is fixed to the engaging part 13*a* of the engaging clip 13 before cutting the wire W with the wire cutter 15 at the wire binding device that will be described as follows.

If the engaging part 13*a* of the engaging clip 13 can be abutted against the wire W under a state in which the wire W is kept to be connected from the bobbin 2 loaded at the binding head 5 of the wire binding device up to the guide beak 3 and a state in which the wire W is abutted against the engaging part 13*a* can be attained, it becomes possible to fix it to the engaging part 13*a* of the engaging clip 13 under an operation of the pushing-out plate 40.

So that it becomes unnecessary every time to perform a work for applying the wire W to the engaging part 13*a* of the engaging clip 13 through a robot arm and the like, and accordingly the wire winding work to the bobbin can be carried out smoothly and continuously.

In addition, at the front surface side of the base plate 29 and a far discharging side from the winding head 4 as seen from the supplying side of the wire W, there is provided a binding device for fastening the wire having its winding terminal end wound from above it and fixing it (hereinafter called as "a binding work") that is arranged at the bobbin 2 after winding operation so as to prevent the wire winding terminal end from being released or its winding from being loosened.

The invention of the wire binding device will be described in detail as follows.

Figure 3:
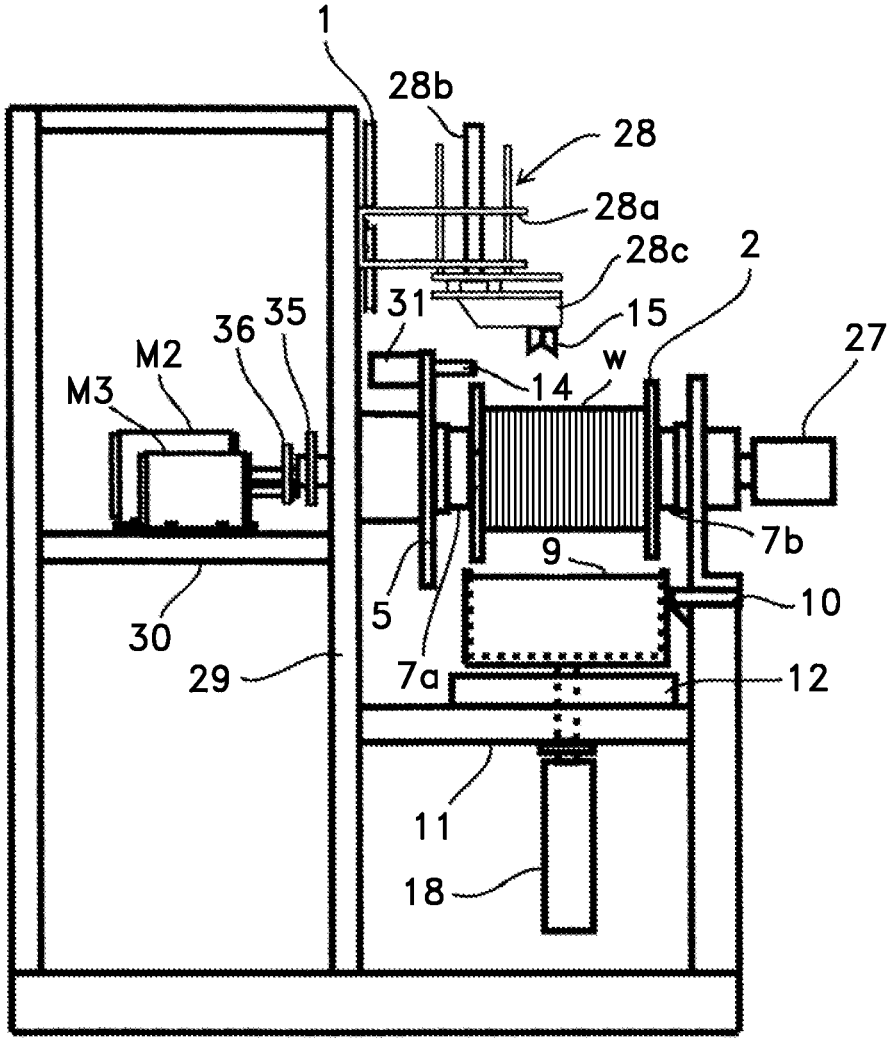
FIG. 3 is a side view showing the automatic bobbin winding device of the present invention.

As shown in FIG. 4, the binding device is set such that a disc-like binding head 5 having its rotating center direction crossed at a right angle is installed at the surface of the base plate 29. A binding head motor M3 for rotating the binding head 5 to a winding direction is arranged at the rear surface side of the base plate 29 as shown in FIG. 3. In addition, at the central front side of the binding head 5, one bobbin chuck 7*a* of both side bobbin chucks 7 opposed to enable the bobbin 2 to be held there between has an axis center in common with a rotational axis center of the binding head 5 and further the bobbin chuck 7*a* is arranged to be rotatable by a chuck rotating motor M2 arranged at the rear surface side of the base plate 29 to a direction opposite to the rotating direction of the binding head 5.

Then, as shown in FIG. 4, there is provided a chuck base plate 10 (the chuck base plate 10 being in common with the base plate having a bobbin chuck 6*b* opposing against a bobbin chuck 6*a* of the winding head 4) arranged at a position spaced apart by about distance added with a length of the bobbin 2 in respect to the winding head 4 from the surface of the base plate 29 and having a substantial same height as that ranging from it to the lower part of the binding head 5. At the upper part of the chuck base plate 10, the other side bobbin chuck 7*b* opposing against the bobbin chuck 7*a* of the binding head 5 is arranged to face against the bobbin chuck 7*a* of the binding head 5, protrudes or retreats under an operation of the chuck cylinder 27 arranged at the rear part to hold the bobbin 2 after its winding and at the same time it is arranged to be rotatable in a driven state in response to the rotation of the held bobbin 2.

Figure 5:
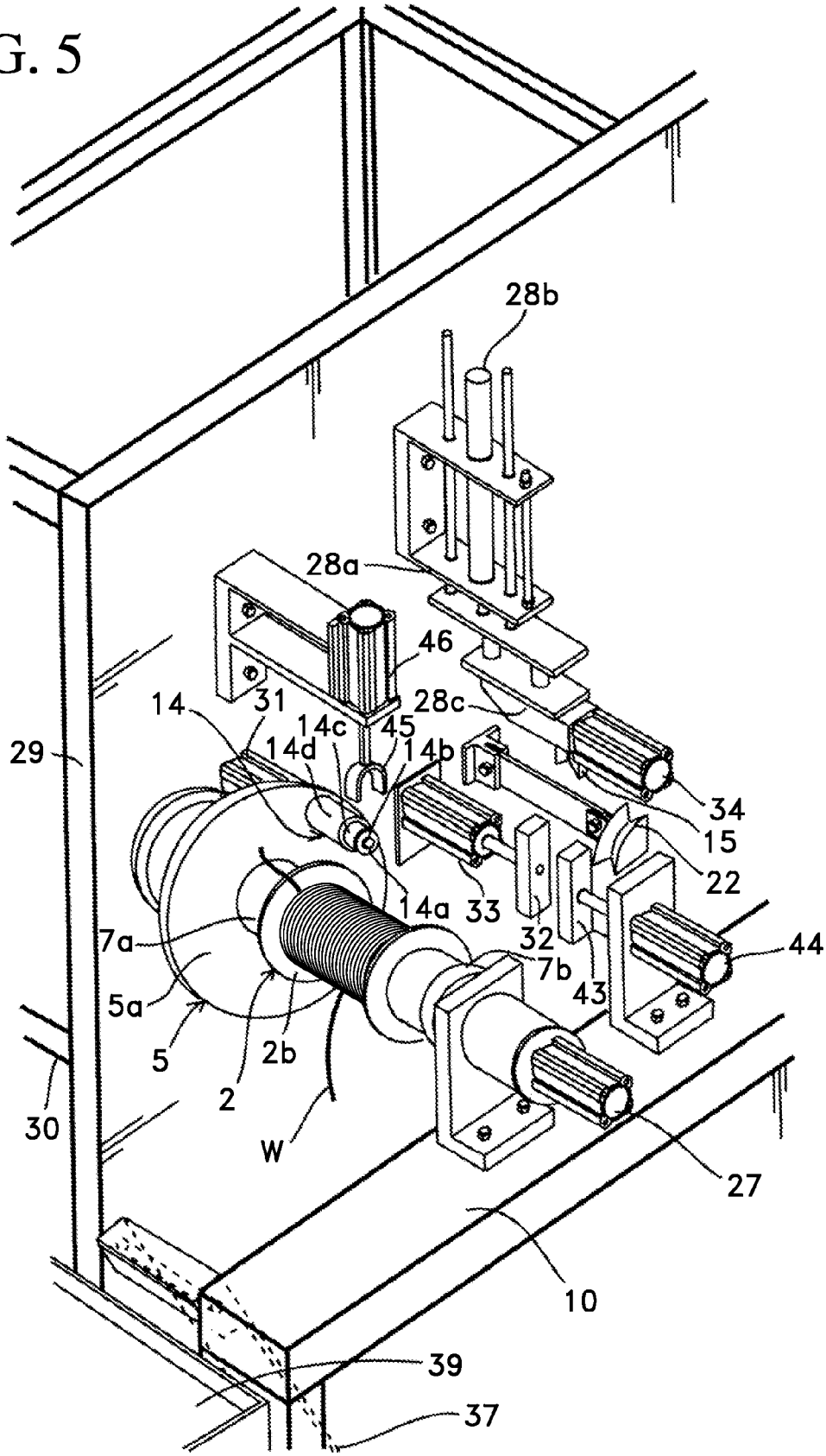
FIG. 5 is a perspective view showing the wire bobbin binding device of the present invention.

As shown in FIG. 5, a wire guide piece 22 is arranged near the bobbin 2 held by the bobbin chuck 7 so as to guide the wire W before winding that is supplied to the bobbin, wound on it and kept to be connected up to a predetermined position in respect to the bobbin 2. The wire guide piece 22 is set such that U-shaped groove with its upper surface being concaved is formed into an arc shape, and the groove facing toward a substantial crossing direction with an axis of the bobbin 2. The wire W on the groove of the wire guide piece 22, can be set in its position approximately near the binding head 5 of a middle position in respect to the axis of the bobbin 2.

Then, a wire cutter 15 is provided near the wire guide piece 22, enable the wire W to be cut at the middle part of the wire W bridged from the bobbin 2 held by the bobbin chuck 7 to the wire guide piece 22.

The wire cutter 15 is operated such that a blade tip of the wire cutter 15 fixed to a blade tip fixing part 28*c* of the wire cutter reciprocating mechanism can be reciprocated by a reciprocating cylinder 28*b* of the wire cutter reciprocating mechanism to a vertical direction from a position spaced apart from the middle portion of the wire W up to its reaching position in respect to the middle location of the bridged wire W by the wire cutter reciprocating mechanism arranged at the base plate 29.

Then, the blade tip of the wire cutter 15 is operated such that its both blades opened like an inverse V-shape are opened or closed to enable the wire held between both blades to be cut.

Opening or closing of both blades can be carried out by operating the wire cutter opening/closing cylinder 34 cooperatively installed for opening or closing both blades.

Figure 7:
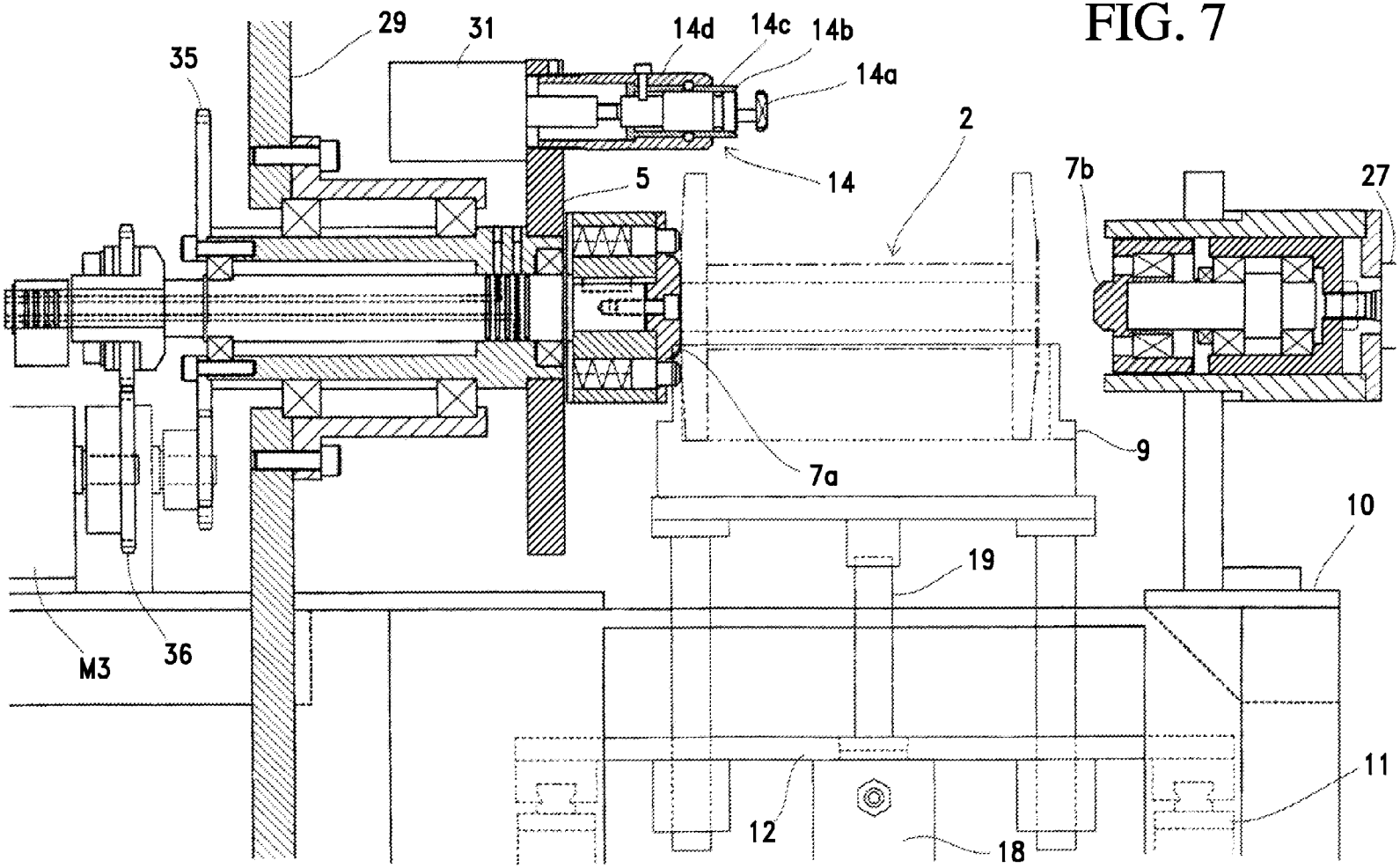
FIG. 7 is a side view in longitudinal section showing a peripheral portion of the binding head.

Then, as shown in FIG. 5 and FIG. 7, a ring creeping clip 14 is provided, at a location near the periphery not contacted with the bobbin 2 held by the bobbin chuck 7*a* of the chuck surface at the front surface of the binding head 5, which have the engaging part 14*a* at the central part can protrude or retreat to a direction in parallel with a shaft of the bobbin 2 under an operation of the ring creeping clip protruding/retreating cylinder 31 arranged at the rear part of the binding head 5.

As shown in FIG. 7, the ring creeping clip 14 is installed such that a wire outer-engaged inner cylinder 14*c* can be sliding to protrude or retreat into a extremity end of cylindrical wire pushing-out outer cylinder 14*d* and an engaging part 14*a* within it can protrude or retreat at the extremity end of the wire outer-engaged inner cylinder 14*c*.

The engaging part 14*a* formed with a disc-like pressing plate of larger diameter than that of a fine shaft at the extremity end of the fine shaft so as to enable the wire W to be engaged with it.

The wire W engaged with the fine shaft at both sides by an engaging/holding part 14*b* at the extremity end of the wire outer-engaged inner cylinder 14*c* and the pressing plate of the engaging part 14*a* is engaged by drawing and holding the pressing plate of the engaging part 14*a* under protruding/retreating operation of the ring creeping clip protruding/retreating cylinder 31, the fine shaft is exposed from the engaging/holding part 14*b* through pushing and the wire W can be engaged with the shaft.

Since the wire outer-engaged inner cylinder 14*c* is used for engaging the wire W with its outer periphery when the ring creeping clip protruding/retreating cylinder 31 is operated to protrude, it can be protruded from the wire pushing-out outer cylinder 14*d* with a certain surplus length. This length shall be set to such a sufficient length as one in which the ring-like engaged wire W may not be easily dropped off.

In addition, when the ring creeping clip protruding/retreating cylinder 31 is operated to retreat, the extremity end of the pressing plate of the engaging part 14*a* of the ring creeping clip 14 is made lower than the flange part 2*b* of the bobbin 2 held by the bobbin chuck 7 and when the wire W is wound around the bobbin 2, it may not be contacted with the wire W. When the ring creeping clip 14 is higher than the flange 2*b*, there occurs a possibility that the wire tangles around the ring creeping clip 14 and the bobbin 2 and a normal wire binding operation cannot be carried out.

Then, the wire binding device of the present invention is operated such that when the wire of the bobbin 2 having the wire wound around it is to be bound, the end part of the wire W wound to a reverse direction around the bobbin 2 in the ring of the wire drawn out while it is engaged with the wire outer-engaged inner cylinder 14*c* of the ring creeping clip 14 in a ring-like manner is engaged with the engaging part 14*a*, the ring-like portion engaged with the wire outer-engaged inner cylinder 14*c* is dropped off outside the engaging part 14*a* to cause the wire W fixed to the engaging part 14*a* to be dived into the ring-like portion, and further the end part of the wire W fixed by the engaging part 14*a* is drawn to cause the ring portion to be drawn and squeezed and generate a plastic deformation of the wire through an acute drawing and squeezing at an interface of the portion engaged with the ring to prevent the plastic deformed portion from being engaged with it and the wire from being drawn into the ring, resulting in that a strong binding can be attained.

In addition, as shown in FIG. 5, a wire pushing/moving stick 32 protruding or retreating against the wire W bridged between the bobbin 2 held by the bobbin chuck 7 and the wire guide piece 22 is fixed to a protruding/retreating shaft of the wire pushing/moving cylinder 33 fixed to the surface of the base plate 29.

In addition, the wire pushing/moving stick 43 opposing against the wire pushing/moving stick 32 while holding the wire W is fixed to the protruding/retreating shaft of the wire pushing/moving cylinder 44 arranged on the chuck base table 10.

The wire pushing/moving sticks 32, 43 are used for holding the wire W bridged between the bobbin 2 and the wire guide piece 22 from both sides and moving the wire W to a direction in parallel with the axis 2*a* of the bobbin 2, under a control of the wire pushing/moving cylinders 33, 44.

Then, an abutting position of the wire W against the ring creeping clip 14 is changed through motion of the wire W and it becomes possible positively to engage the wire W with or disengage the wire W from the wire outer-engaged inner cylinder 14*c* of the ring creeping clip 14 or to engage it with the engaging part 14*a* of the ring creeping clip 14.

Although the wire pushing/moving sticks 32, 43 can perform positively to hold the wire W from both sides at a predetermined position of the ring creeping clip 14, the wire W strikes against only one side in accordance with the position of the wire guide piece 22 against the bobbin 2 held by the bobbin chuck 7, resulting in that it may also be applicable that the wire pushing/moving sticks 32, 43 are arranged only at one side where the wire W abuts against it.

Further, in the case that its structure is made such that an operation of the ring creeping clip 14 enables the wire W bridged between the bobbin 2 held by the bobbin chuck 7 and the wire guide piece 22 to be moved to a more free position, it is not necessary to move the position of the wire W and it is possible to eliminate it.

In addition, as shown in FIG. 5, a fork-shaped wire pushing/releasing claw 45 with its winding side being formed longer than a cutting side while the extremity end portion of the ring creeping clip 14 being held so as to enable the wire W engaged with the extremity end of the ring creeping clip 14 to be pushed and released is arranged above it in such a way that it can protrude or retreat against the extremity end portion of the ring creeping clip 14 under an operation of the wire pushing/releasing claw operating cylinder 46 fixed and arranged at the base plate 29.

The wire pushing/releasing position would be a stopping position of the ring creeping clip 14. In the case that the wire pushing/releasing claw 45 is operated to a vertical direction, when the ring creeping clip 14 is set to the position spaced apart by 90° from where it reaches up to the most-upper part of the binding head 5, it is preferable because it abuts against the wire when the wire pushing/releasing claw 45 is dropped from just above it.

However, in the case that the wire pushing/releasing claw 45 is operated to a vertical direction, when the ring creeping clip 14 is set to the position where it reaches up to the most-upper part of the binding head 5, it is not preferable because sometimes the wire pushing/releasing claw 45 dropped from just above it does not abut against it.

The wire pushing/releasing claw 45 can prevent the irregularly deformed cut end of the cut wire W from tangling with the ring creeping clip 14 or surrounding goods or the like and stopping in operation or the like and prevent some troublesome states from being produced in its subsequent stages.

In the wire binding device of the present invention, the aforesaid configuration enables the bobbin 2 having finished the wire W winding to be held with the bobbin chuck 7 and the wire W to be bound mechanically at the bobbin winding terminal portion through operation of each of the units of the binding head 5, the bobbin chuck 7, the ring creeping clip 14, the wire pushing/moving sticks 32, 43 and the wire cutter 15, and the operation of the wire pushing/releasing claw 45 enables a continuous binding work to be positively carried out without any stoppage in operation.

Then, there will be described about a lift enabling motion of the bobbin 2 and its loading to both bobbin chucks 6 and 7 at the automatic bobbin winding device provided with the wire binding device.

As shown in FIG. 1, FIG. 3 and FIG. 7, the lift is constituted such that a lift base table 11 is arranged below the chuck base table 10 and the lift is movably arranged on the lift base table 11.

Due to this arrangement, a bobbin transfer table 12 as fixed a bobbin lift 9 can be reciprocated to a vertical direction under an operation of the lower bobbin lift cylinder 18, and the bobbin transfer table 12 is slid horizontally on an installed rail and the like to enable the bobbin lift 9 to be reciprocated between the winding head 4 and the binding head 5.

As shown in FIG. 2, the bobbin transfer table 12 enables reciprocated under an operation of lift reciprocating shaft 21*a* arranged to a reciprocating direction is operated by the lift reciprocating cylinder 21.

This bobbin lift 9 enables the vacant bobbin 2 to be supplied to the winding head 4 and further enables the bobbin to be supplied to the binding head 5 after the supplied wire W is wound onto the bobbin 2.

Then, the wound bobbin 2 is processed such that the terminal end of the bound portion of the wire W is cut, and the bobbin 2 completely winding up the wire is cut away completely from the device and then the bobbin 2 can be discharged out of the device.

Although the bobbin lift 9 can be attained in its embodiment in which one bobbin lift is operated to be reciprocated and another embodiment in which several bobbin lifts are operated to reciprocate, for example, as shown in FIG. 1, that two bobbin lifts 8, 9 are arranged in the bobbin transfer table 12.

In this example, the two bobbin lifts 8, 9 are arranged to be spaced apart in correspondence with the positions of the winding head 4 and the binding head 5, the bobbin lift 9 at the binding head 5 is arranged to be reciprocatable between one location just below the winding and the other location just below the binding head 5.

The bobbin lift 8 at the winding head 4 can be reciprocated to a vertical direction under an operation of the bobbin lift cylinder 16 arranged at the lower side through a bobbin lift shaft 17, and similarly, the bobbin lift 9 at the binding head 5 can also be reciprocated to a vertical direction under an operation of the bobbin lift cylinder 18 arranged at the lower part through the bobbin lift shaft 19.

In the case of the two bobbin lifts 8, 9, a supplying of the vacant bobbin 2 to the winding head 4 and a supplying of the bobbin 2 wound with the wire W to the binding head 5 can be carried out simultaneously under an operation of the bobbin transfer table 12 performed once, so that an efficient operation can be performed.

Although the bobbins 2 can be loaded to the bobbin chucks 6, 7 with the bobbin lefts 8, 9, supplying of the vacant bobbin 2 to the bobbin lift 8 so as to be loaded to the winding head 4 can be carried out by guiding each of the bobbins from the stock part storing many vacant bobbins 2 through the supplying passage onto the bobbin lift 8 kept in its lowered state, and it can also be carried out by holding each of the bobbins with the robot arm and loading it onto the bobbin lift 8.

In addition, FIG. 1 and FIG. 2 show on the discharging of the bobbin 2 having the wound wire W released from the bobbin chuck 7 of the binding head 5 to the outside. If a bobbin discharging guide plate 37 is formed a downward gradient from extremity end to base end, having the extremity end movable up to a location just below the bobbin chuck 7 of the binding head 5, when the bobbin 2 having the wound wire W that is released from the bobbin chuck 7 of the binding head 5, can be received below it, dropped onto an outer bobbin receiver 39 and can be discharged outside.

The embodiment in which a shaft 38*a* of the bobbin discharging guide plate ascending/descending cylinder is controlled pushed/drawn by a bobbin discharging guide plate ascending/descending cylinder 38 to cause the bobbin discharging guide plate 37 to be slid to a vertical direction to lift up the extremity end to a location just below the bobbin chuck 7, to formed a downward gradient.

In addition, it is also possible to attain an embodiment in which the inclined bobbin discharging guide plate is slid from the left side to a horizontal direction so as to discharge the bobbin 2 having wound wire W and the higher extremity end is set just below the bobbin chuck 7.

Although not shown in the drawings, the operation of each of the motors used and the operation of the cylinder under application of air are carried out automatically through an electrical wiring or an air pressure feeding pipe under a program control of a computer or an electronic circuit in response to an operating procedure in operation of each of the associated segments.

Then, a sequence in operation of the winding work of the automatic bobbin winding device will be described in the following items (1) to (6).

(1) At first, as shown in FIG. 1, the wire W wound around the reels R installed at the supply reel stand S is guided and supplied to an adjustment roll 20 through a measuring roll 1, 1' and further the wire W is guided to a guide beak 3 faced toward a axis 2*a* of the bobbin 2 held at the bobbin chuck 6 of the winding head 4.

Then, the vacant bobbin 2 is set to the bobbin lift 8 on the bobbin transfer table 12, moved from below the winding head 4 between the bobbin chucks 6*a*, 6*b* under an operation of the bobbin lift cylinder 16, the vacant bobbin 2 is held by the bobbin chucks 6*a*, 6*b* under an operation of the chuck cylinder 26 and then the loading to the winding head 4 is finished. Then, the bobbin lift 8 is lowered under an operation of the bobbin lift cylinder 16.

These series of operation are carried out every time the bobbin 2 is moved from the winding head 4 to the binding head 5.

Then, the extremity end of the wire W guided up to the guide beak 3 is set such that the clip pushing/moving cylinder 41 is operated to protrude the pushing-out plate 40, the pushing-out part 13*b* of the engaging clip 13 is pushed to cause the extremity end engaging part 13*a* to be protruded and the wire W is engaged with the engaging part 13*a*.

Then, the clip pushing/moving cylinder 41 is operated to cause the pushing-out plate 40 to be retreated and the extremity end of the wire W is held at the engaging part 13*a* of the engaging clip 13 and fixed there.

The first work for engaging the wire W with the engaging part 13*a* of the engaging clip 13 is carried out by a robot arm. However, when the robot arm is not installed, only one first work is performed by a worker.

(2) Next, the bobbin 2 held at the bobbin chuck 6 of the winding head 4 is rotated by several turns only through rotation of the winding head 4 performed by the winding head motor Ml, the wire W is wound around the shaft 2*a* of the bobbin 2, its lower part is depressed with its upper part and it is fixed.

Since the wire W is not released from the bobbin 2 due to fixing of the wire W to the bobbin 2, the clip pushing/moving cylinder 41 is operated to cause the pushing-out plate 40 to be protruded to push the pushing-out part 13*b* of the engaging clip 13 and protrude the extremity end engaging part 13*a*, the wire W fixed to the engaging part 13*a* of the engaging clip 13 is released, and then the clip pushing/moving cylinder 41 is operated to retreat the pushing-out plate 40 and the engaging part 13*a* of the engaging clip 13 is caused to retreat from the extremity end of the cylinder 13*c* under biasing of the coil spring 13*d*.

(3) Then, the bobbin 2 held at the bobbin chuck 6 of the winding head 4 is rotated under a rotation of the winding head 4 by the winding head motor M1 and the wire W is wound to the bobbin 2 by a predetermined length in a uniform layer in the bobbin 2 while axial reciprocating motion of the guide beak 3 being applied toward the axis 2*a*.

(4) Then, the bobbin lift 9 on the bobbin transfer table 12 is moved from below the winding head 4 to a location just below the bobbin 2 having the wire W just completed in its winding under an operation of the bobbin lift cylinder 18 and an operation of the lift reciprocating shaft 21*a*, the bobbin chucks 6*a*, 6*b* are opened under an operation of the chuck cylinder 26. Then, the dropped bobbin 2 is transferred to the bobbin lift 9.

After this operation, as shown in FIG. 2, the bobbin 2 mounted on the bobbin lift 9 is transferred to the binding head 5 under an operation of the bobbin lift cylinder 18 and an operation of the lift reciprocating shaft 21*a*.

At this time, the wire W is kept in its non-cut state and drawn and the wire is moved toward the binding head 5 of the bobbin 2.

(5) Then, the bobbin 2 held by the bobbin chucks 7*a*, 7*b* of the binding head 5 is operated such that the wire W wound by the bobbin binding device (described blow) is bound to the bobbin 2 at its terminal end.

(6) Next, the bobbin 2 wound with the wire W after being completed in its winding operation is released from the bobbin chuck 7 of the binding head 5 under an operation of the chuck cylinder 27.

At this time, the bobbin discharging guide plate 37 is moved to a location just below the bobbin chuck 7 of the winding head 5, the bobbin 2 released from the bobbin chuck 7 is dropped onto the bobbin discharging guide plate 37, the bobbin 2 is received from it to a slanted surface of downward gradient and guided onto the outer bobbin receiver 39.

Figure 8A:
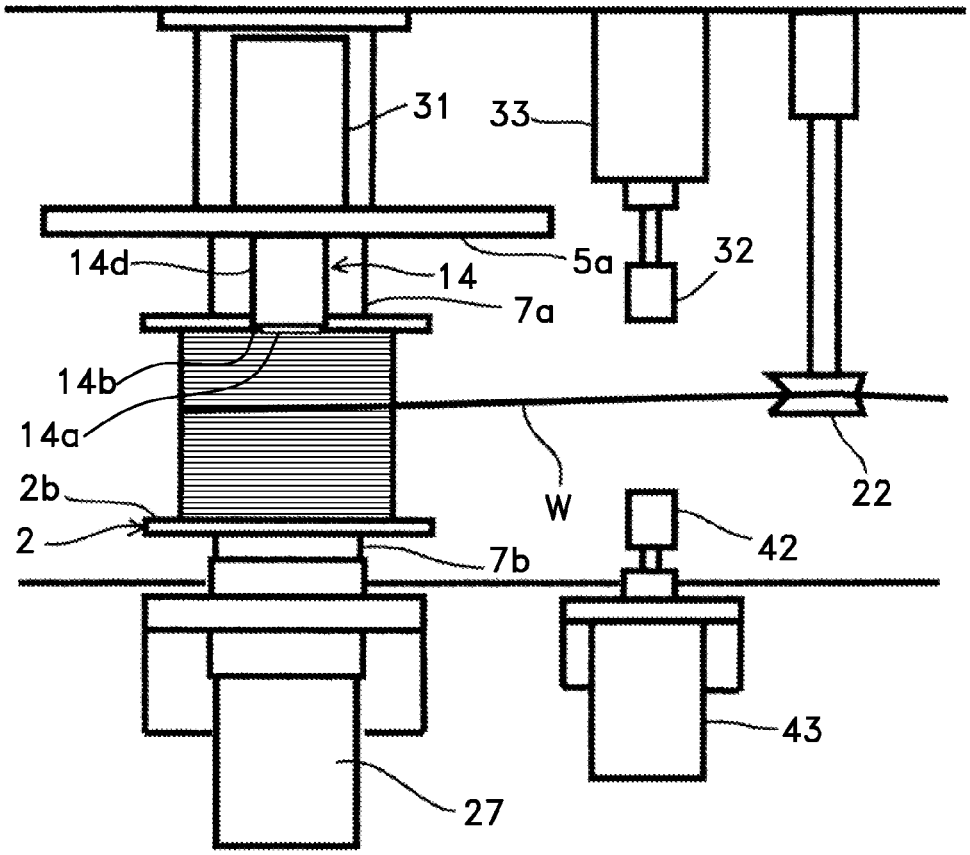
FIG. 8A is a plan view showing a state of binding stage performed by the wire bobbin binding device, wherein the bobbin winding the wire is held by the bobbin chuck.
Figure 8B:
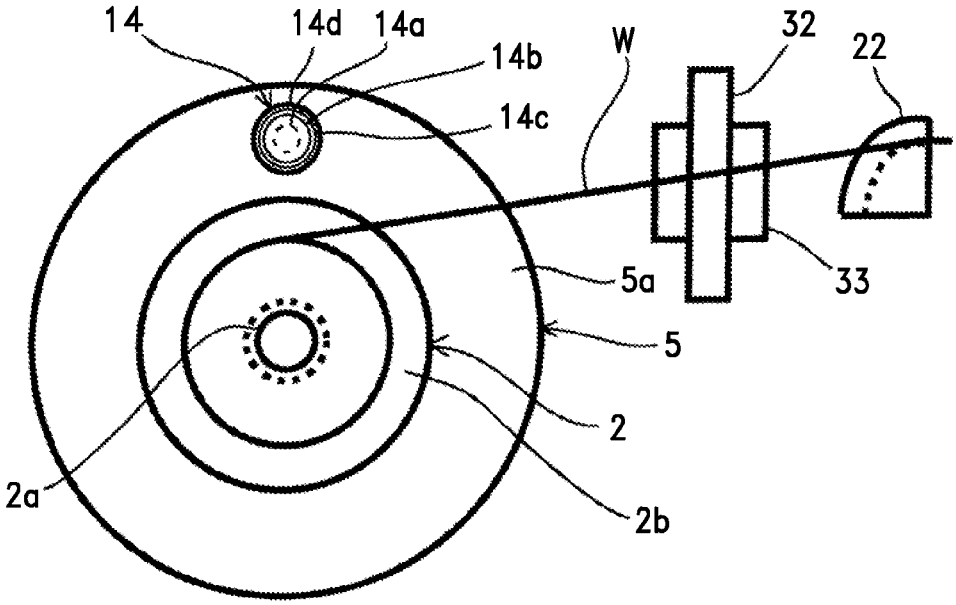
FIG. 8B is a front view showing a state of binding stage performed by the wire bobbin binding device, wherein the bobbin winding the wire is held by the bobbin chuck.

Next, the binding work sequence performed by the bobbin binding device described in the working order (5) in the winding work of the automatic bobbin winding device described above will be described in the items (a) to (i) as follows:

(a) As shown in FIG. 8A and FIG. 8B, the bobbin 2 held by the bobbin chucks 7*a*, 7*b* of the binding head 5 is rotated by the chuck rotating motor M2 for the bobbin chuck 7*a* to the winding direction, i.e., a counter-clockwise direction in FIG. 8B, to cause the wire W to eliminate looseness between the wire guiding pieces 22 and keep its tensioned state.

Figure 9A:
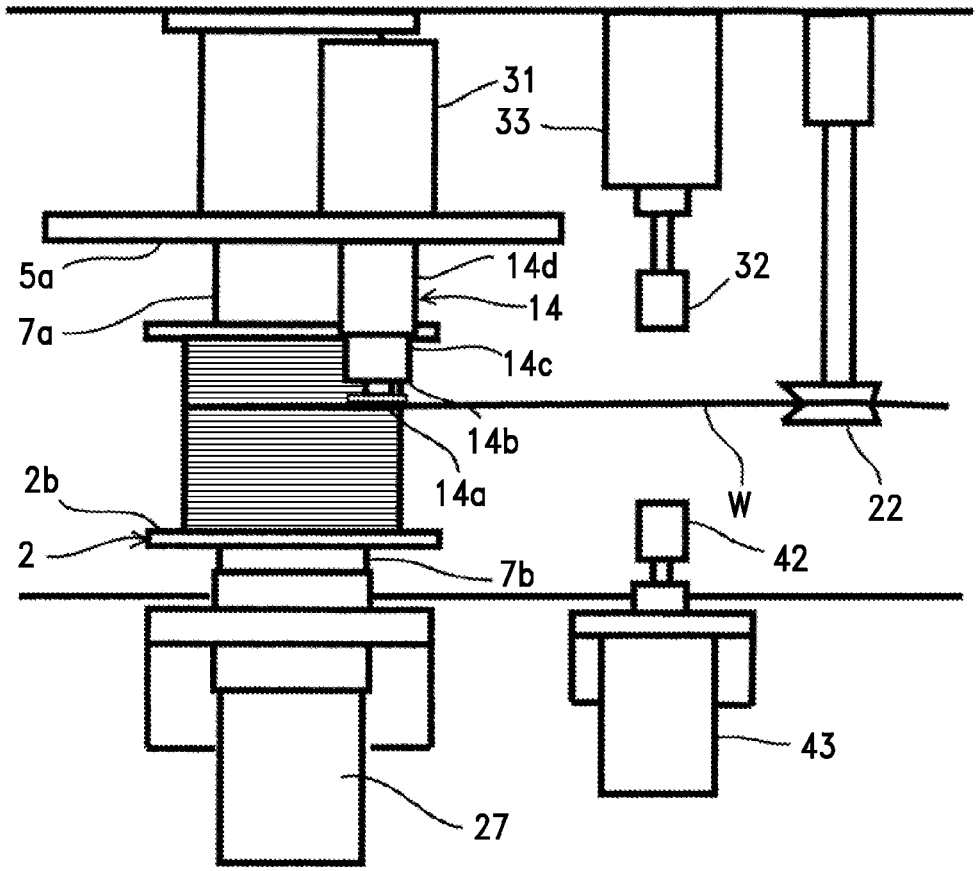
FIG. 9A is a plan view showing a state of the protruded wire outer-engaged inner cylinder of the ring creeping clip.
Figure 9B:
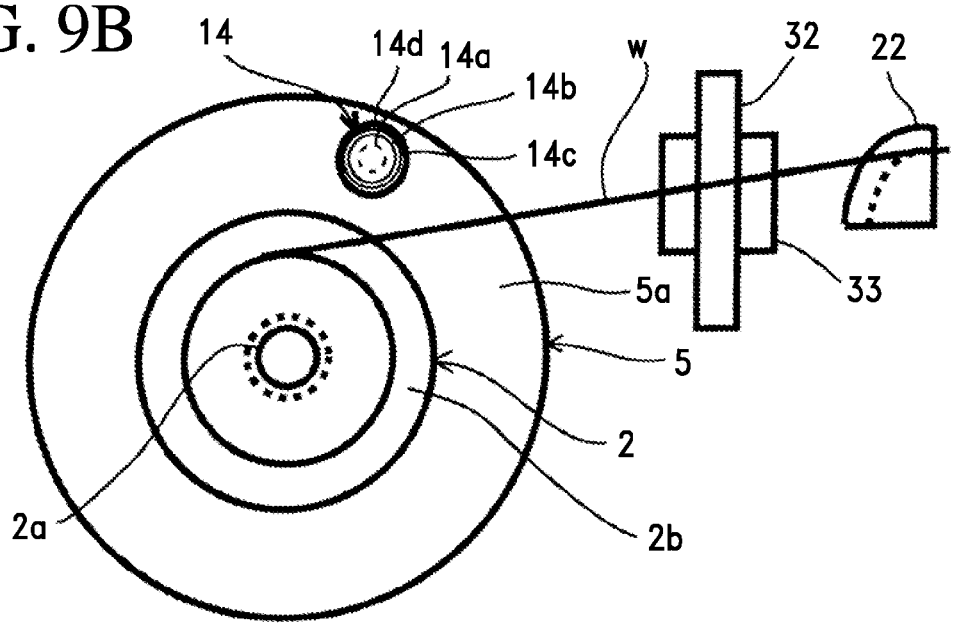
FIG. 9B is a front view showing a state of the protruded wire outer-engaged inner cylinder of the ring creeping clip.

(b) As shown in FIG. 9A and FIG. 9B, the ring creeping clip 14 installed at the binding head 5 is protruded through protruding or retreating operation of the ring creeping clip protruding/retreating cylinder 31.

Figure 10A:
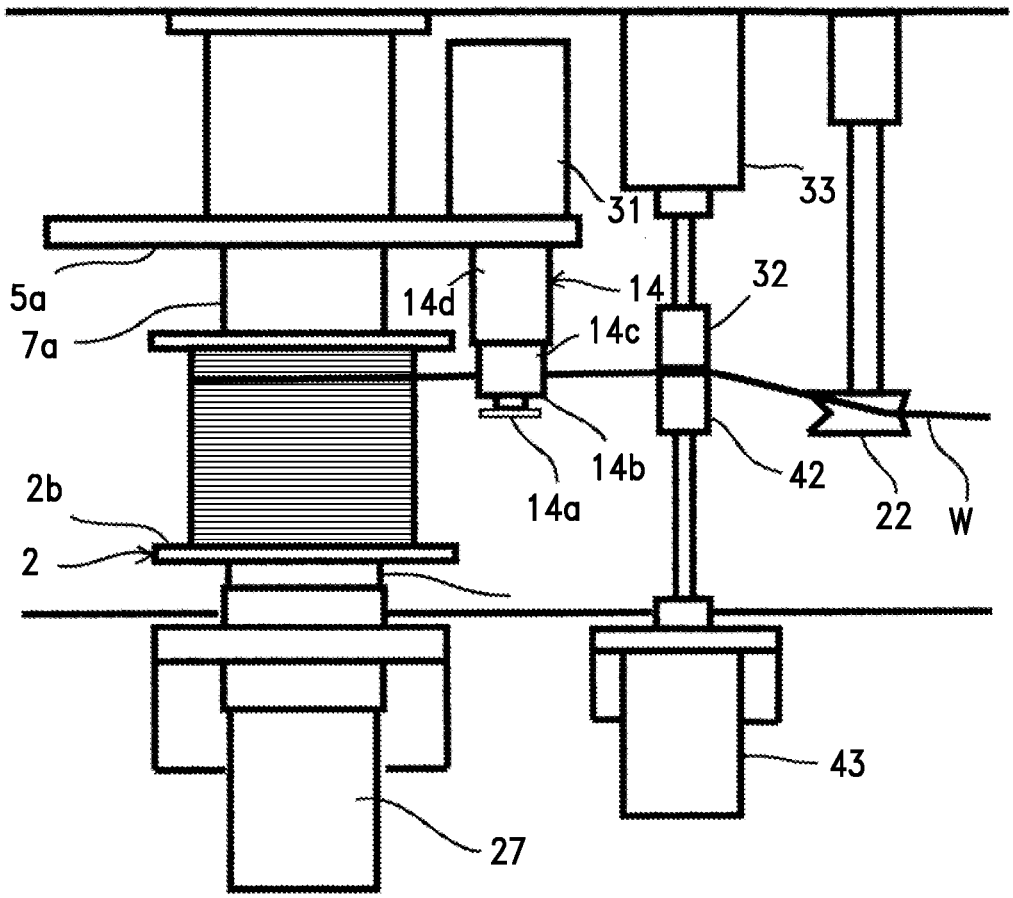
FIG. 10A is a plan view showing a state in which the wire is moved to a position where it is engaged with the wire outer-engaged inner cylinder with the wire pushing/moving stick.
Figure 10B:
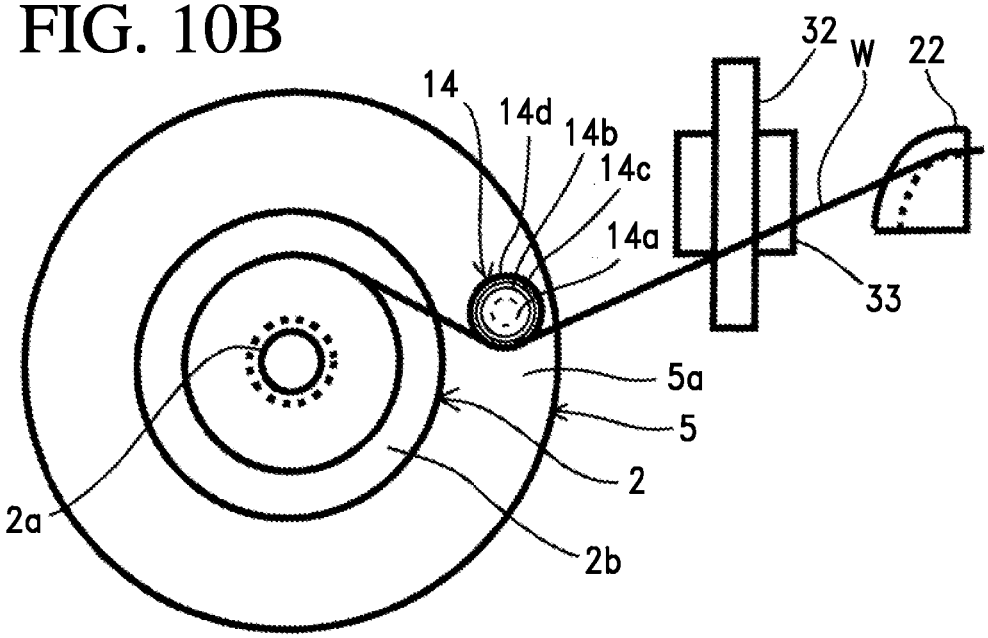
FIG. 10B is a front view showing a state in which the wire is moved to a position where it is engaged with the wire outer-engaged inner cylinder with the wire pushing/moving stick.

(c) As shown in FIG. 10A and FIG. 10B, the wire pushing/moving cylinders 33, 44 are operated to hold the wire W with the wire pushing/moving sticks 32, 43 and move the held wire W to the engaged position of the wire outer-engaged inner cylinder 14*c* protruded from the ring creeping clip 14.

Figure 11A:
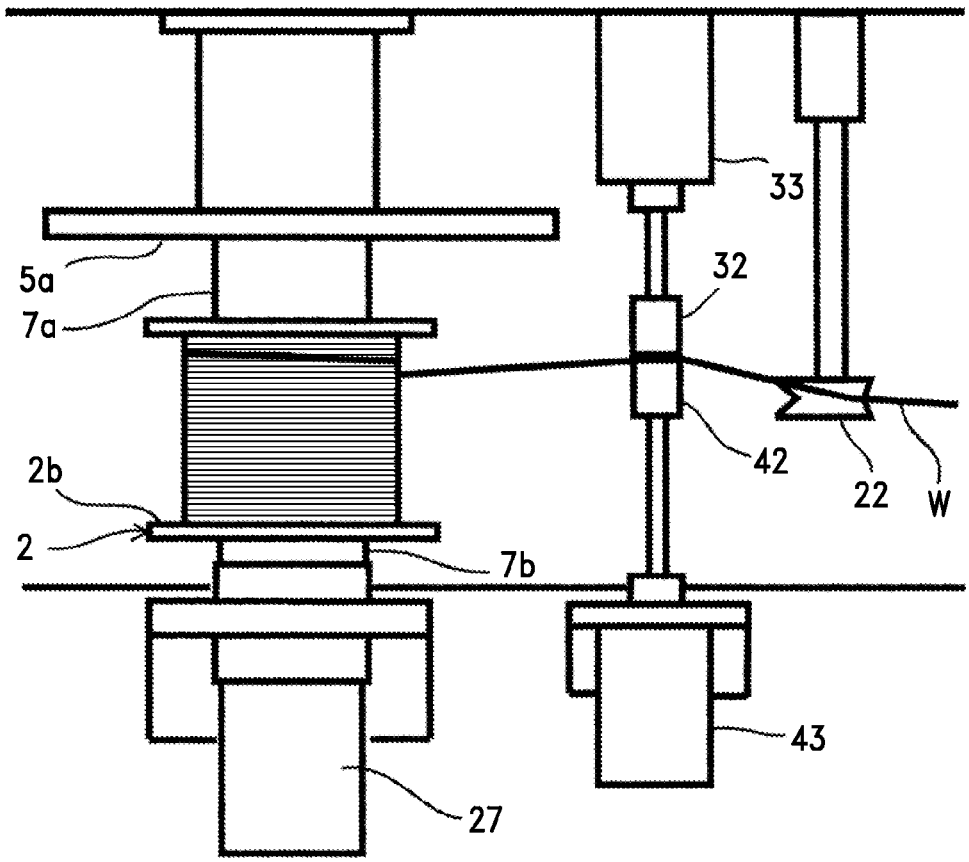
FIG. 11A is a plan view showing a state in which the wire engaged with the wire outer-engaged inner cylinder is pulled down.
Figure 11B:
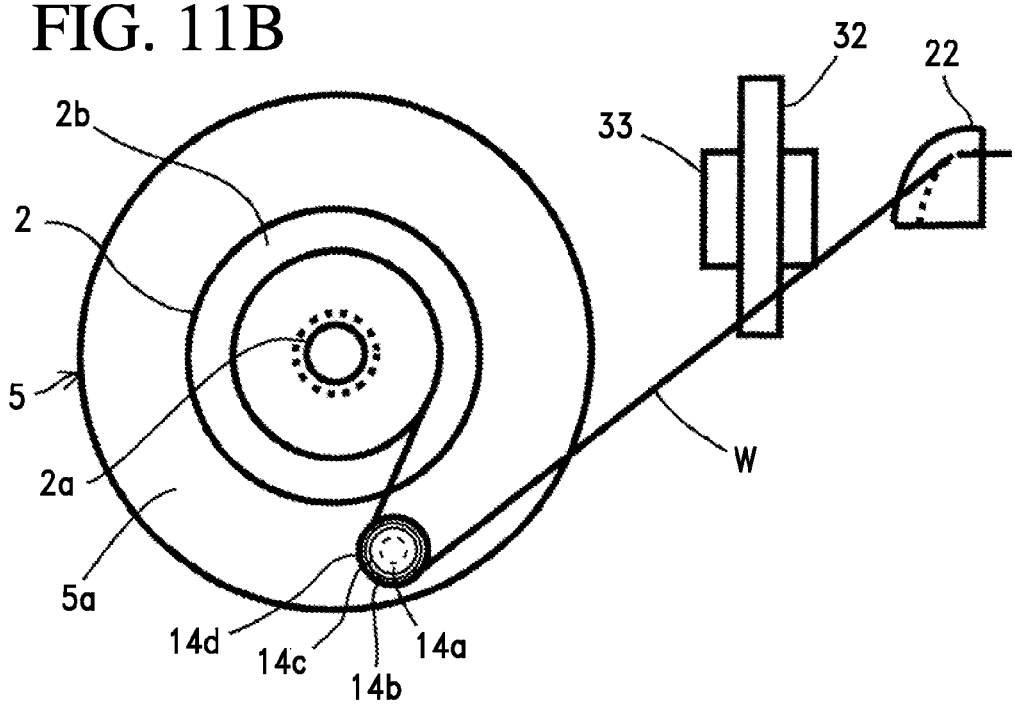
FIG. 11B is a front view showing a state in which the wire engaged with the wire outer-engaged inner cylinder is pulled down.

(d) As shown in FIG. 10B and FIG. 11B, the binding head 5 is rotated to a clockwise direction in FIG. 11B in opposition to the rotation of the bobbin chuck 7, the middle part of the wire W engaged with the wire outer-engaged inner cylinder 14*c* is drawn to be bent downward.

Figure 12A:
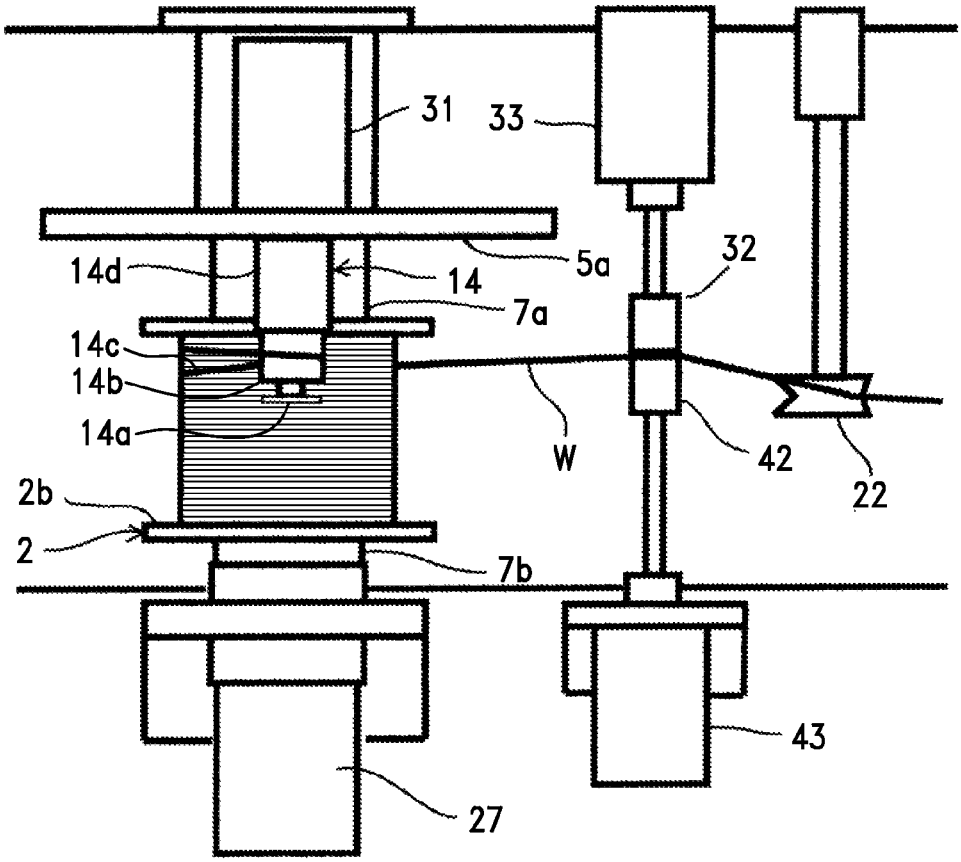
FIG. 12A is a plan view showing a state in which the wire engaged with the wire outer-engaged inner cylinder is drawn and turned.
Figure 12B:
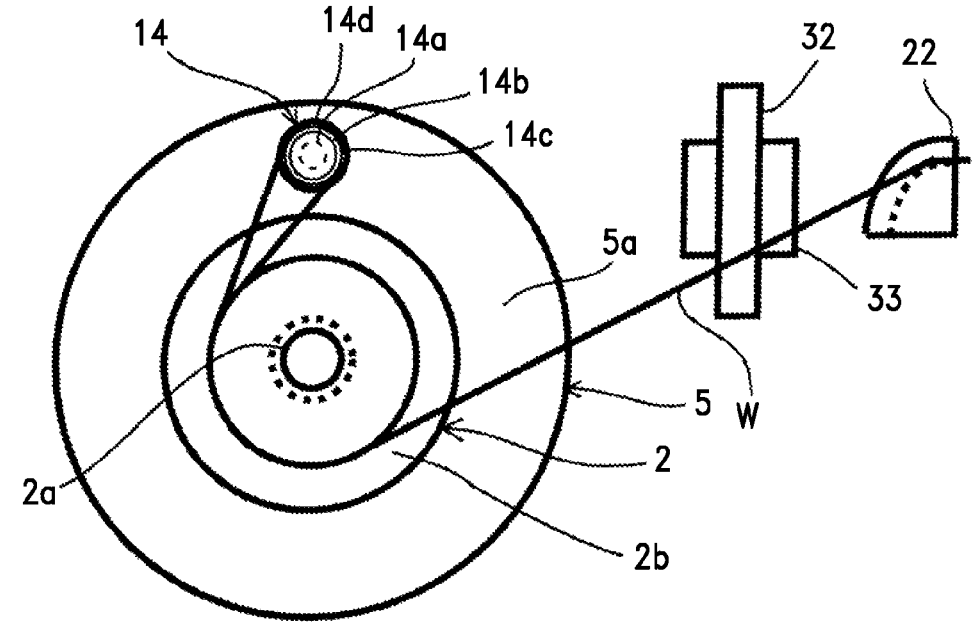
FIG. 12B is a front view showing a state in which the wire engaged with the wire outer-engaged inner cylinder is drawn and turned.

Then, further, the binding head 5 is rotated only once or several times to make a ring of the wire W engaged with the wire outer-engaged inner cylinder 14*c* of the ring creeping clip 14 as shown in FIG. 12B.

Figure 13A:
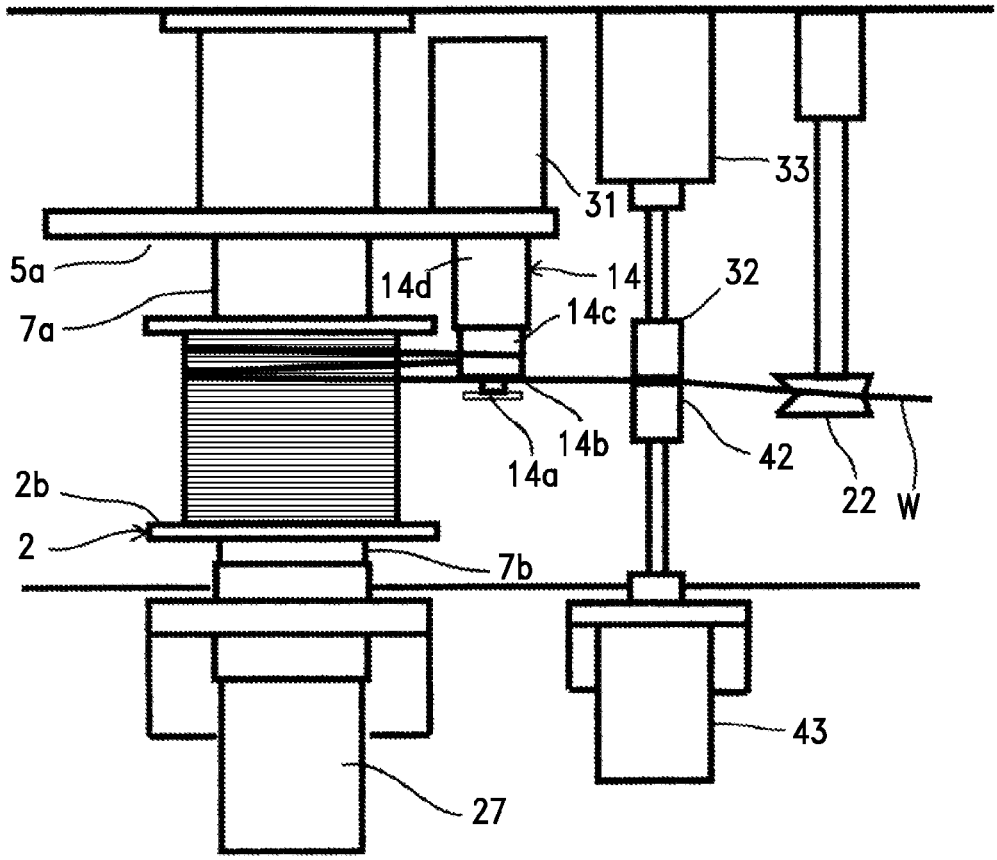
FIG. 13A is a plan view showing a state in which the wire engaged with the wire outer-engaged inner cylinder is turned around the bobbin once and the engaging part is engaged with the drawing-out side of the wire.
Figure 13B:
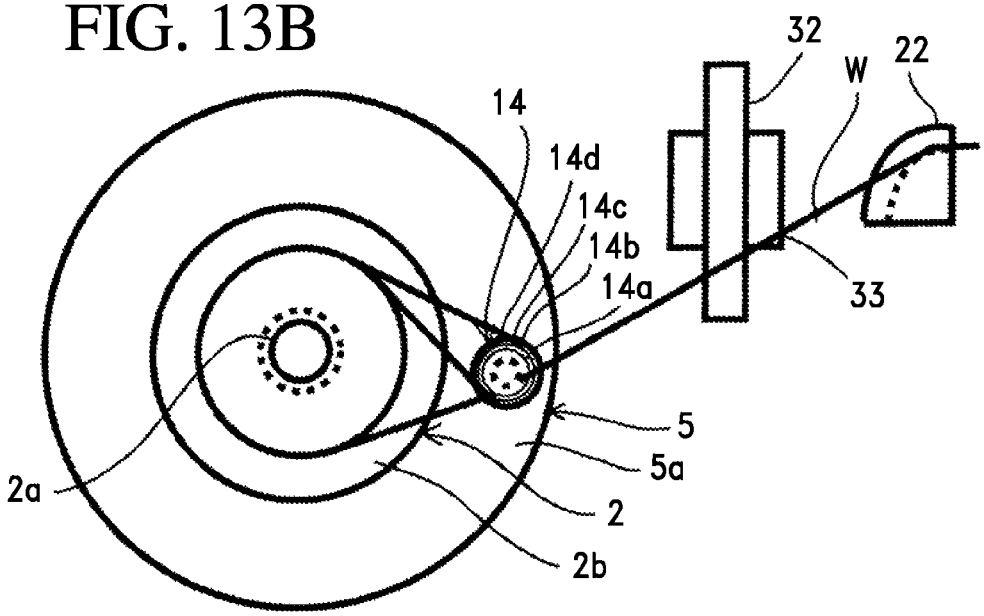
FIG. 13B is a front view showing a state in which the wire engaged with the wire outer-engaged inner cylinder is turned around the bobbin once and the engaging part is engaged with the drawing-out side of the wire.
Figure 14A:
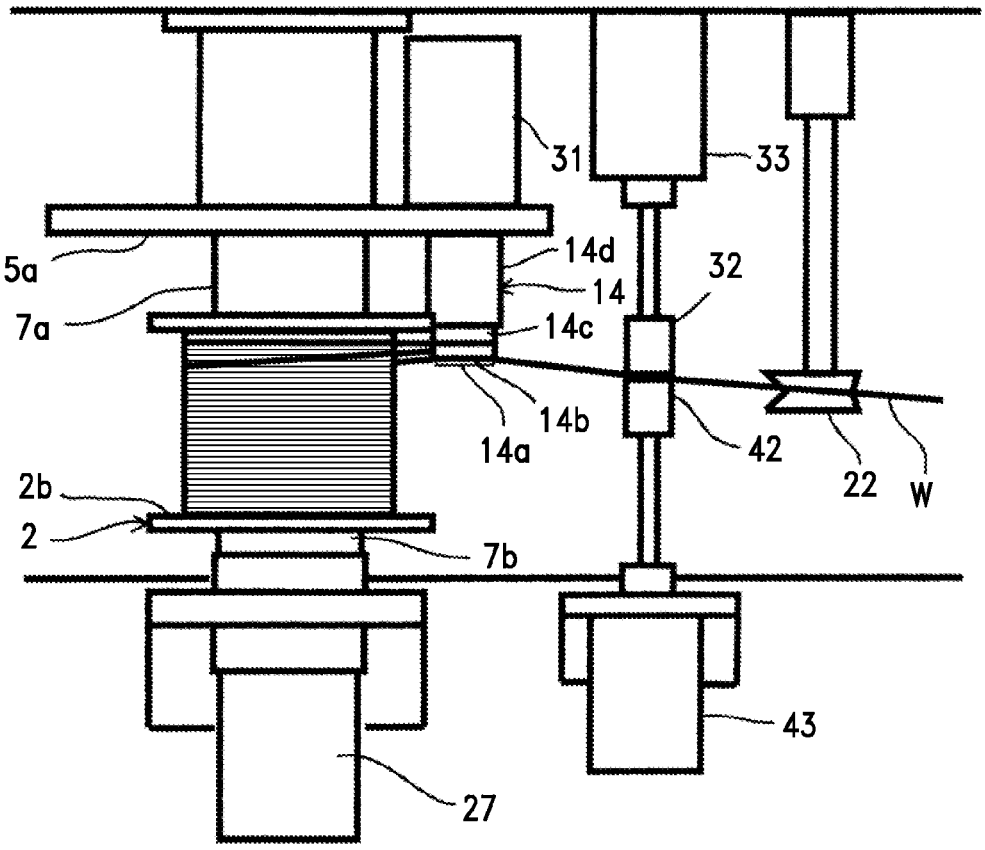
FIG. 14A is a plan view showing a state just before the wire engaged with the engaging part is dived into the ring formed by engaging the wire with the engaging part and engaging it with the wire outer-engaged inner cylinder.
Figure 14B:
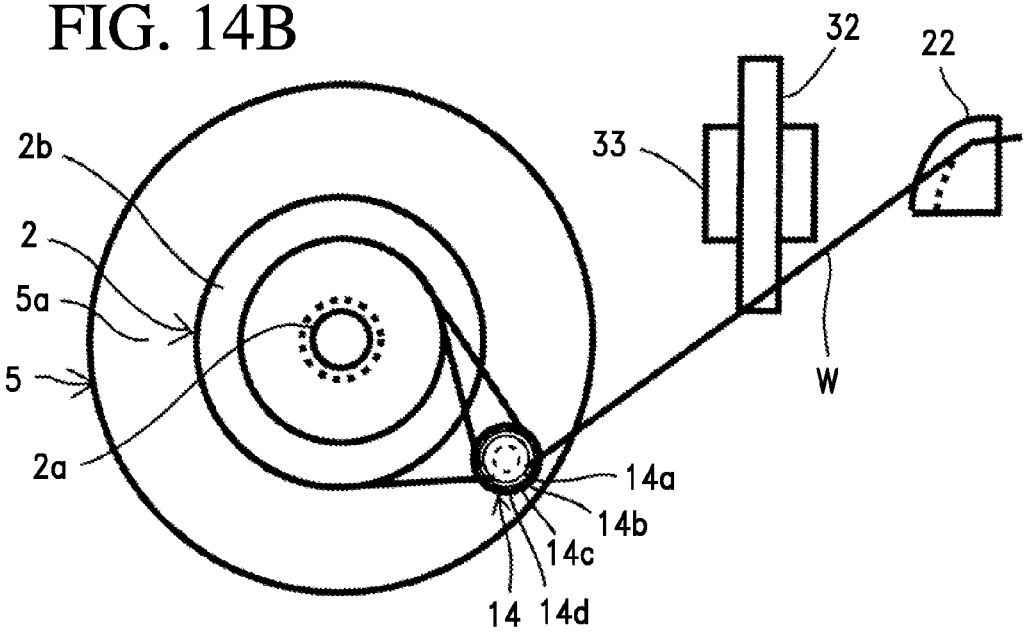
FIG. 14B is a front view showing a state just before the wire engaged with the engaging part is dived into the ring formed by engaging the wire with the engaging part and engaging it with the wire outer-engaged inner cylinder.

(e) As shown in FIG. 13A and FIG. 13B, the wire pushing/moving cylinders 33, 44 are operated to move the wire pushing/moving sticks 32, 43 holding the wire W so as to cause the wire W to occupy the position where the wire is engaged with the engaging part 14*a* of the ring creeping clip 14, rotates the binding head 5 as it is and abuts the wire W against the engaging part 14*a* protruded from the ring creeping clip 14 as shown in FIG. 14A and FIG. 14B.

Figure 15A:
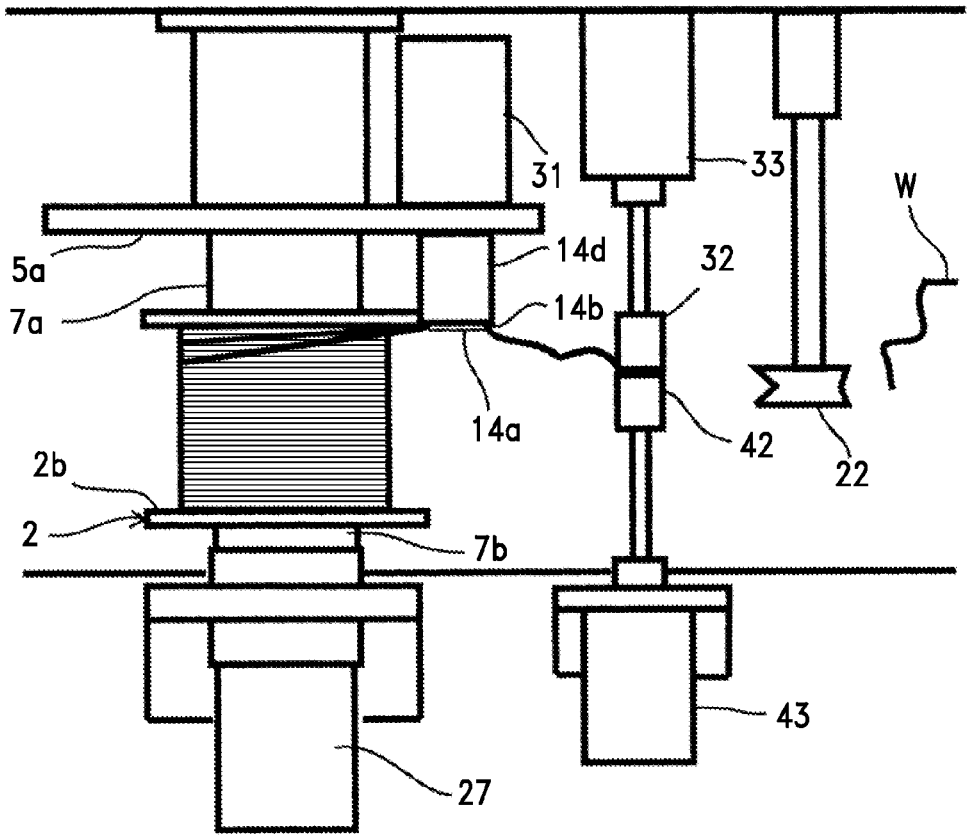
FIG. 15A is a plan view showing a state in which the wire is cut and the ring is squeezed by the wire dived out of the ring formed by being engaged with the wire outer-engaged inner cylinder.

(f) As shown in FIG. 15A, the ring creeping clip protruding/retreating cylinder 31 is operated to cause the engaging part 14*a* of the ring creeping clip 14 to retreat and further the portion of the wire W abutted against the engaging part 14*a* to be held between the engaging part 14*a* and the engaging/holding part 14*b* and fixed there.

Figure 15B:
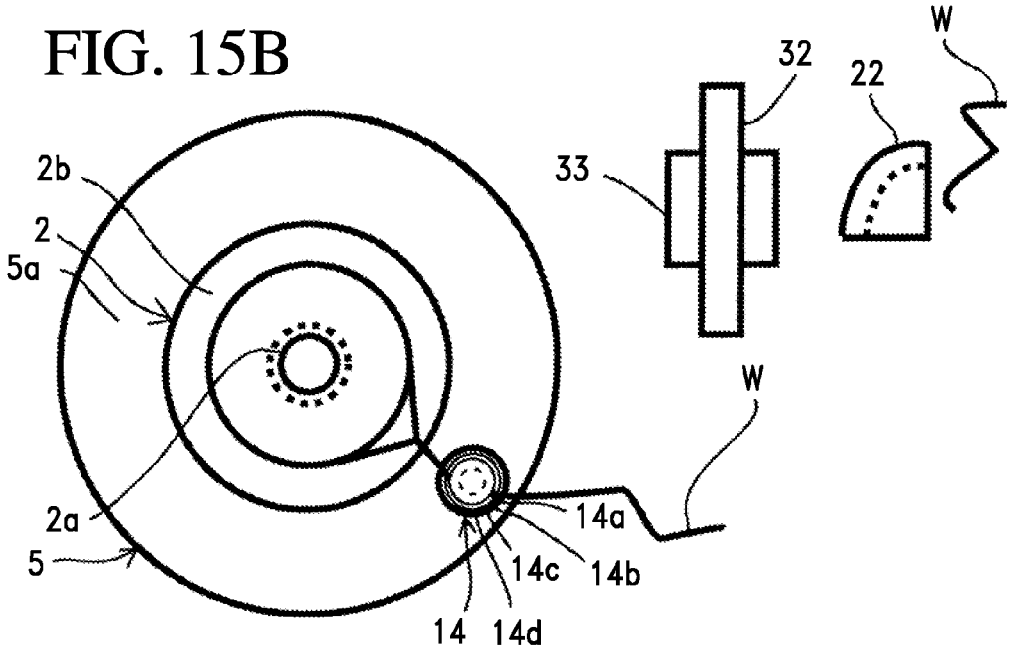
FIG. 15B is a front view showing a state in which the wire is cut and the ring is squeezed by the wire dived out of the ring formed by being engaged with the wire outer-engaged inner cylinder.

At this time, the wire W that has been engaged with the wire outer-engaged inner cylinder 14*c* is pushed out with the extremity end of the wire pushing-out outer cylinder 14*d* and dropped off from the wire outer-engaged inner cylinder 14*c*. And as shown in FIG. 15B, it is dropped off from the wire outer-engaged inner cylinder 14*c* under a state in which the portion fixed in the engaging part 14*a* is left in the ring part of the dropped wire W, so that the wire W having the part fixed to the engaging part 14*a* is dived into the ring and engaged there.

During this stage, the wire W fixed to the engaging part 14*a* of the ring creeping clip 14 is cut between the wire guide pieces 22 through an operation of the wire cutter opening/closing cylinder 34 by moving the blade tip of the wire cutter 15 up to the wire W.

Figure 16A:
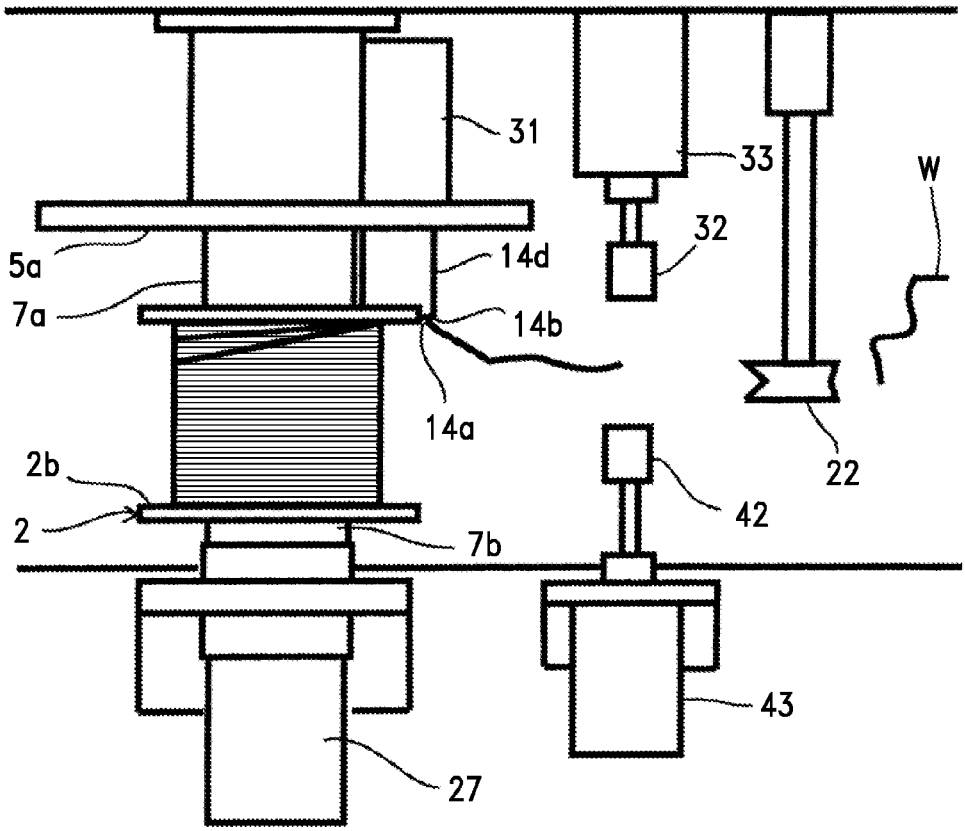
FIG. 16A is a plan view showing a state in which the ring creeping clip is turned to draw and squeeze the wire.
Figure 16B:
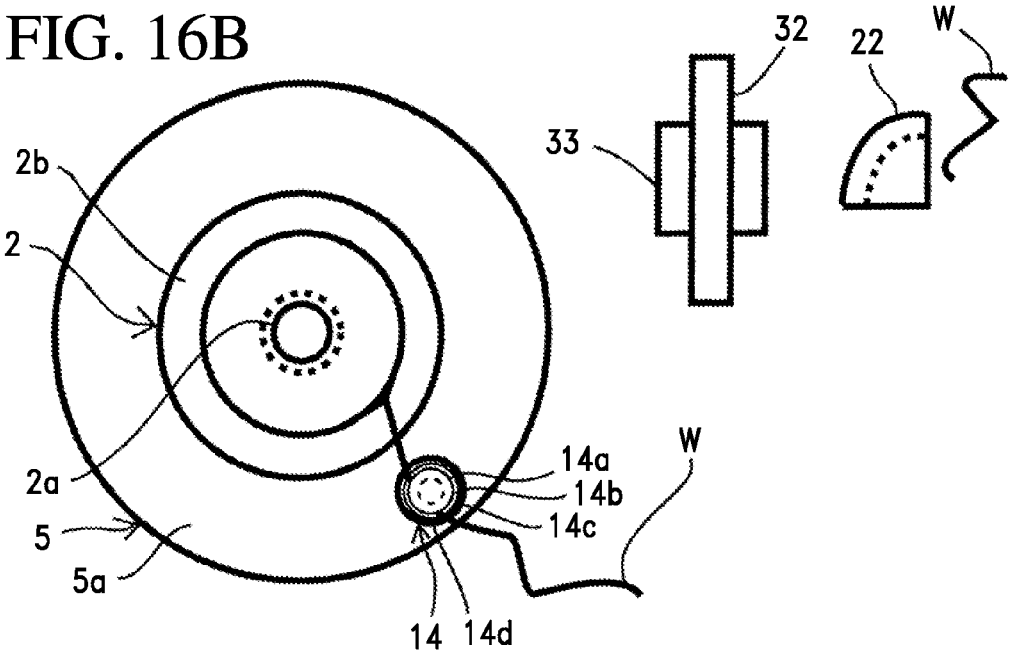
FIG. 16B is a front view showing a state in which the ring creeping clip is turned to draw and squeeze the wire.

(g) As shown in FIG. 16A and FIG. 16B, the binding head 5 is rotated as it is and the wire W is pulled toward its rotating direction.

Figure 17A:
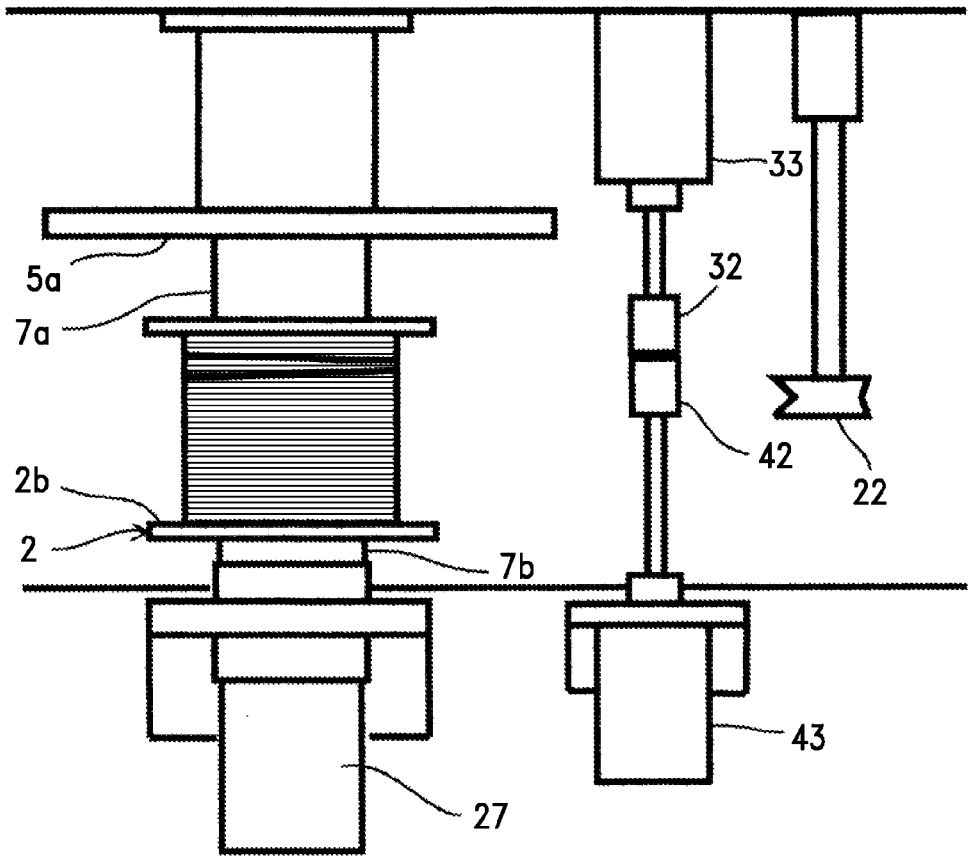
FIG. 17A is a plan view showing a state in which the drawn and squeezed wire is bound.
Figure 17B:
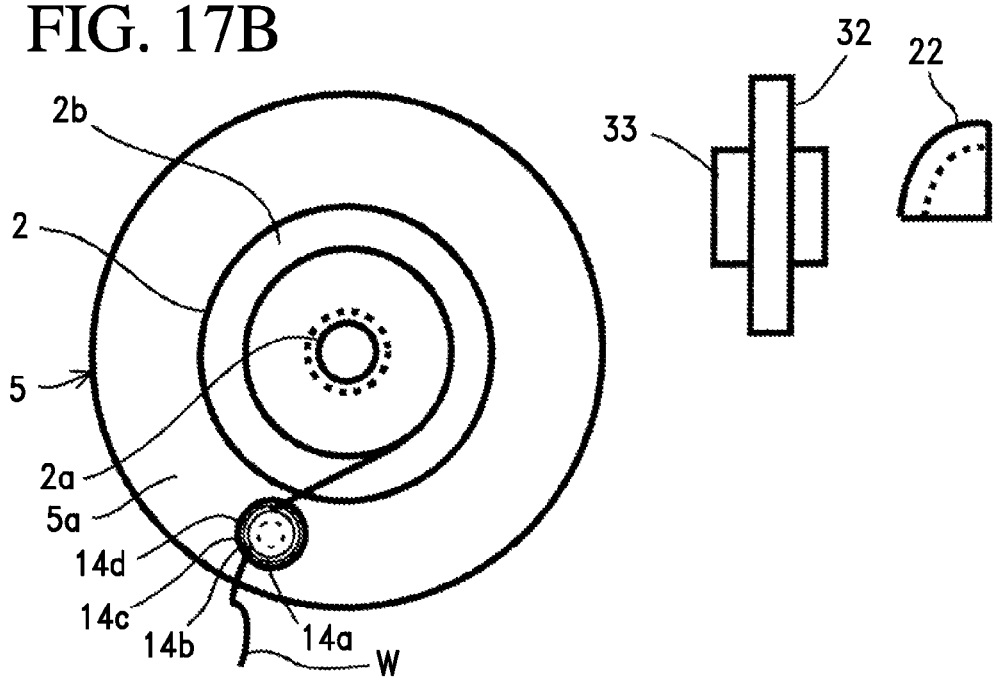
FIG. 17B is a front view showing a state in which the drawn and squeezed wire is bound.

Then, as shown in FIG. 16B, the ring is drawn and squeezed and the ring is strongly drawn and squeezed as shown in FIG. 17B to have no clearance between it and the lower winding wire.

Figure 18A:
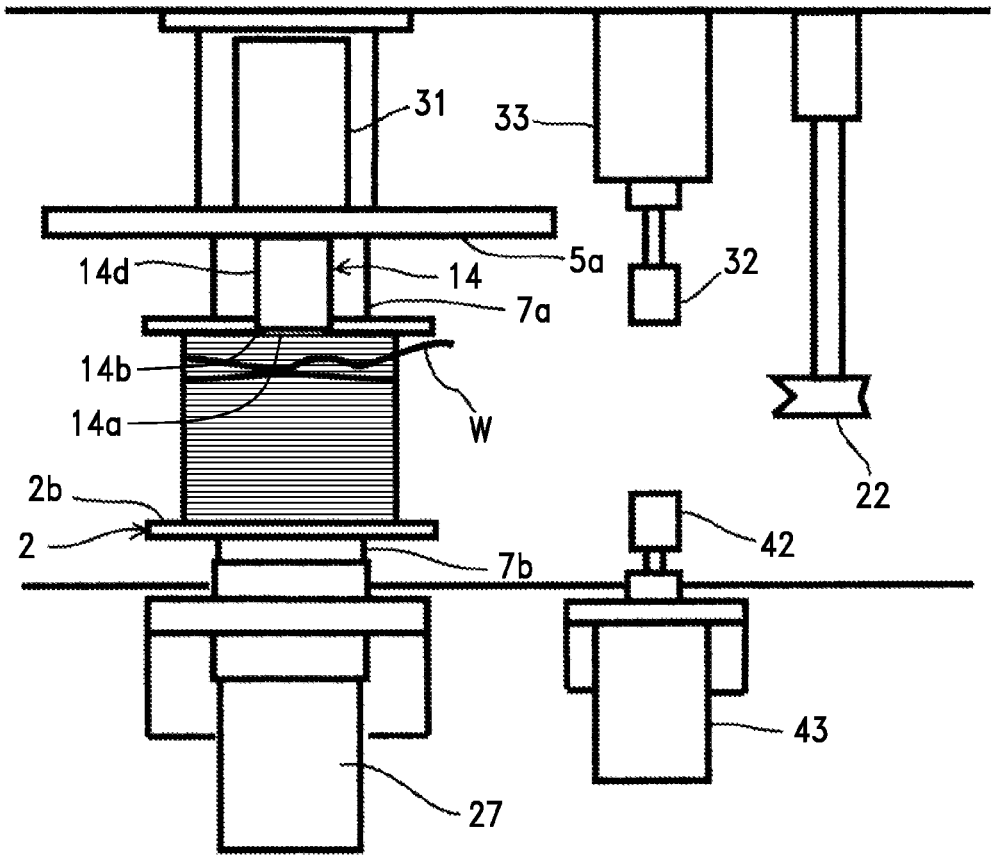
FIG. 18A is a plan view showing a state in which the engaging part is removed from the bound wire.
Figure 18B:
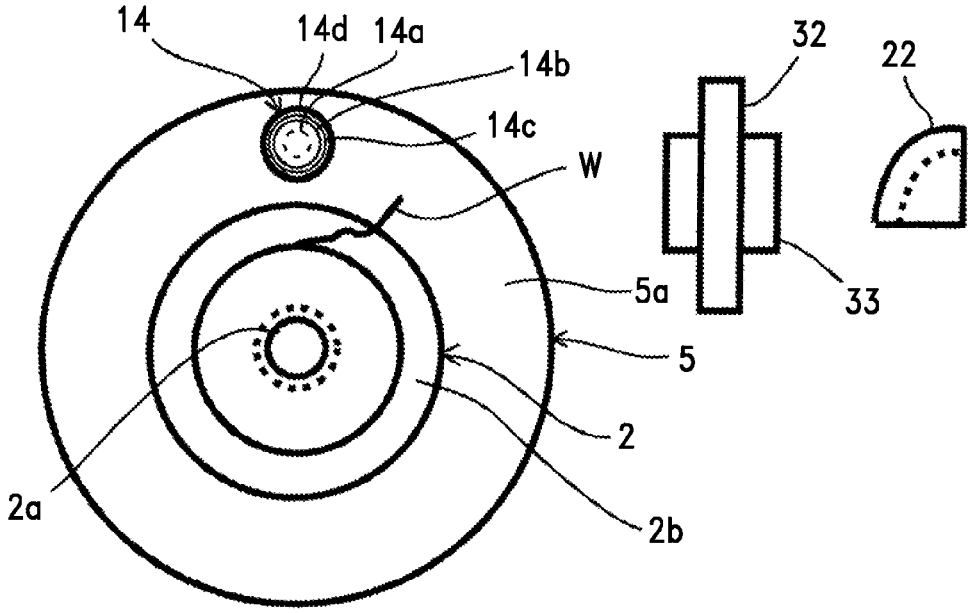
FIG. 18B is a front view showing a state in which the engaging part is removed from the bound wire.

(h) As shown in FIG. 18A and FIG. 18B, after this operation, when the binding head 5 is rotated as it is and the drawing and squeezing of the ring part of the wire W cannot be carried out, the wire W is drawn out in friction from between the engaging part 14*a* of the wire W and the engaging/holding part 14*b*, the wire up to the terminal end cut to the final state is drawn out and released from the engaging part 14*a* against a holding force between the engaging part 14*a* of the wire W and the engaging/holding part 14*b*.

At this time, a twisted irregular deformation generated by a drawing and squeezing force at the part of the ring of the drawing and squeezing portion and the cut part of the wire W, a plastic deformed portion of the cut wire W is engaged with it and not drawn back into the ring, resulting in that it becomes possible to perform a strong binding like a bound wire.

(i) With the foregoing, a wire binding is completed, the wire W is wound and finally bound to cause the bobbins 2 wound with wire W are separated from the device and each of them is independently discharged out of the device one by one.

The wire W made of metal such as steel wire can be divided full-automatically into many exclusive bobbins independently by the automatic bobbin winding device using the wire bobbin binding device, and the fact that an unmanned operation of a factory that has been understood as an impossible operation up to now can be realized is an outcome that has not been attained ever.

Although the automatic bobbin winding device using the wire bobbin binding device of the present invention mainly aim at processing of a metallic wire such as a steel wire and the like, the wire is not limited to a metallic one, but the present invention can be used for the wire such as mixed material of metal and resin that is wound onto a bobbin.

The invention claimed is:

1. A wire bobbin binding device in which a disc-like binding head having its rotational central direction crossed at a right angle with a front surface of a plane-like upright base plate is rotatably arranged at said front surface side of the base plate by a motor arranged at a rear surface side of said base plate, one bobbin chuck of both bobbin chucks opposing to enable the bobbin to be held is rotatably arranged at a central front surface of said binding head to a rotating direction opposite to a rotating direction of said binding head at a rotational center in common with a rotational center of said binding head by a motor arranged at a rear surface of said base plate, a chuck base table is arranged in front of said base plate, the other bobbin chuck opposing against the bobbin chuck of said binding head is caused to protrude or retreat at the upper part of said chuck base table under an operation of a chuck cylinder arranged at the rear side toward the bobbin chuck of said binding head so as to hold the bobbin and rotatably arranged to be driven in response to a rotation of said held bobbin, wire guide pieces for guiding said wire to a part before the bobbin at the side of the wire supplied to a bobbin near the bobbin held by said bobbin chuck and a wire cutter reciprocatable by a cylinder from a spaced-apart position up to a position where it can reach the wire tensioned between said bobbin and said wire guide pieces are arranged at said base plate, the bobbin finished for winding the supplied wire is held by said bobbin chuck, a ring creeping clip protruded at a location of the chuck surface of said binding head not contacted with the bobbin while rotating said binding head by each of said motors is operated to protrude or retreat by a cylinder arranged at a rear side of said chuck surface, said wire is bound at the bobbin winding terminal end, the terminal end of the binding portion of said wire is cut, made to be independent and can be discharged, wherein said ring creeping clip can hold and release said wire guided by said wire guide pieces between an central engaging part and its outer engaging/holding part while the engaging part protrudes or retreats from its outside engaging/holding part under an operation of a cylinder arranged at a rear side, provided with a wire outer-engaged inner cylinder having a length capable of engaging said wire when it is protruded at an outer periphery of the engaging/holding part under an operation of the cylinder provided at the rear side and a wire pushing-out outer cylinder arranged at the outer periphery of said wire outer-engaged inner cylinder and enabling its extremity end to protrude or retreat from the extremity end of said wire outer-engaged inner cylinder to its tip end, said binding head is rotated, the end part of the wire reversely wound at said bobbin is engaged with said engaging part in the ring of the wire engaged in a ring manner at the wire outer-engaged inner cylinder of said ring creeping clip and drawn out under an operation of the cylinder arranged at the rear side, the ring part engaged with said wire outer-engaged inner cylinder is dropped off the outside of said engaging part to cause the end part of the wire fixed by said engaging part to be dived into the ring part, and further said binding head is rotated to cause the end part of the wire dived into said ring part to be pulled and squeezed by said engaging part, both drawing and squeezing portions of said wire are bent and deformed and can be wound so as not to be pulled out of said ring part.

2. The wire bobbin binding device according to claim 1, wherein a wire pushing/releasing claw protruded or retreated to enable the wire engaged with the extremity end of said ring creeping clip to be pushed and released under an operation of the cylinder provided at the rear side is arranged near the ring creeping clip at the surface side of the base plate.

3. The wire bobbin binding device according to claim 1, wherein a stick surface is arranged in at least an upper or lower oscillation range of the wire between the bobbin held by the bobbin chucks and the wire guide piece, the wire pushing/moving stick advanced or retarded in parallel to a direction of a rotary axis of the bobbin along the bobbin under an operation of a cylinder arranged at the rear side is arranged in such a way that the wire pushing/moving stick can be pushed and moved to a position where the wire is engaged with the wire outer-engaged inner cylinder and a position where the wire is engaged with the engaging part of the ring creeping clip.

4. The bobbin binding device according to claim 1, wherein a supplying side of a vacant bobbin before winding at a surface side of the base plate in common with said binding device is provided with a disc-like winding head having a rotary center direction crossed at a right angle with the surface of said base plate in a rotatable manner by a motor arranged at the rear surface of said base plate and at the same time the central front side of said winding head is provided with a first bobbin chuck of a pair of opposed first and second bobbin chucks to enable the bobbin to be held at an axial center thereof in common with the rotary axis of said winding head, a chuck base table arranged in front of said base plate, the upper part of said chuck base table provided with the second bobbin chuck opposing against the first bobbin chuck of said winding head, the second bobbin chuck caused to protrude or retreat under an operation of a chuck cylinder arranged at the rear side of the second bobbin chuck and facing toward the bobbin chuck of said winding head to hold the bobbin and arranged to be rotatable in response to a rotation of said held bobbin, a location of the chuck surface of said winding head not contacted with the bobbin provided with a engaging clip having an engaging part for engaging with a middle part of the wire at its extremity end to cause said engaging part to protrude or retreat by reciprocating a pushing-out part arranged at the rear side of the chuck surface of said winding head under an operation of a cylinder installed at the rear side of said base plate to enable the wire to be held by said engaging part, a guide beak installed on a traverse table to enable the wire on a rotating bobbin to be wound in an arranged row while guiding the wire to an axial direction of the bobbin held by said first and second bobbin chucks and reciprocating it at the wire supplying side of said base plate rather than at a position of said winding head, the winding device for the wire wound on the bobbin arranged at a discharging side of the bobbin after winding the wire, a bobbin lift reciprocatable in a vertical direction under an operation of a bobbin lift cylinder arranged at a lower side is installed through the bobbin transfer table on a lift table arranged below said chuck base table and at the same time said bobbin transfer table enables the bobbin lift to be reciprocated between said winding head and the binding head by a shaft of a lift reciprocating cylinder that can be reciprocated in parallel with the surface side of said base plate to a horizontal direction, and the wire supplied from the guide beak to the bobbin supplied to said winding head and binding head by the bobbin lift is wound and bound, the bobbin is cut from the wire at the supplying side and can be discharged therefrom.

5. The automatic bobbin winding device according to claim 4, wherein a pushing-out plate is formed into a fine arc shape within a range abutted against the pushing-out part of the engaging clip around the winding head by a range of 90° ranging from the upper-most part to the wire binding device side, and said engaging clip can push the pushing-out part of the engaging clip by said pushing-out plate at a position ranging from the upper part of the winding head to the binding device.

6. The automatic bobbin winding device according to claim 4, wherein there are provided two bobbin lifts arranged at the bobbin transfer table, said two bobbin lifts are arranged under an interval corresponding to positions of the winding head and binding head, and the bobbin lift at said binding head side can be reciprocated between one position just below said winding head and the other position just below said binding head.

7. The automatic bobbin winding device according to claim 4, wherein a bobbin discharging guide plate formed under a descending gradient from a position just below the bobbin held by the bobbin chucks of the binding head toward a discharging direction is arranged to be movable up to a position where it may not be contacted with the moving bobbin lift, and the bound and cut-away bobbin removed from the bobbin chuck of said binding head can be received from below and discharged.

8. The bobbin binding device according to claim 2, wherein a supplying side of a vacant bobbin before winding at a surface side of the base plate in common with said binding device is provided with a disc-like winding head having a rotary center direction crossed at a right angle with the surface of said base plate in a rotatable manner by a motor arranged at the rear surface of said base plate and at the same time the central front side of said winding head is provided with a first bobbin chuck of a pair of opposed first and second bobbin chucks to enable the bobbin to be held at an axial center thereof in common with the rotary axis of said winding head, a chuck base table arranged in front of said base plate, the upper part of said chuck base table provided with the second bobbin chuck opposing against the first bobbin chuck of said winding head, the second bobbin chuck caused to protrude or retreat under an operation of a chuck cylinder arranged at the rear side of the second bobbin chuck and facing toward the bobbin chuck of said winding head to hold the bobbin and arranged to be rotatable in response to a rotation of said held bobbin, a location of the chuck surface of said winding head not contacted with the bobbin provided with a engaging clip having an engaging part for engaging with a middle part of the wire at its extremity end to cause said engaging part to protrude or retreat by reciprocating a pushing-out part arranged at the rear side of the chuck surface of said winding head under an operation of a cylinder installed at the rear side of said base plate to enable the wire to be held by said engaging part, a guide beak installed on a traverse table to enable the wire on a rotating bobbin to be wound in an arranged row while guiding the wire to an axial direction of the bobbin held by said first and second bobbin chucks of said winding head and reciprocating it at the wire supplying side of said base plate rather than at a position of said winding head, the winding device for the wire wound on the bobbin arranged at a discharging side of the bobbin after winding the wire, a bobbin lift reciprocatable in a vertical direction under an operation of a bobbin lift cylinder arranged at a lower side is installed through the bobbin transfer table on a lift table arranged below said chuck base table and at the same time said bobbin transfer table enables the bobbin lift to be reciprocated between said winding head and the binding head by a shaft of a lift reciprocating cylinder that can be reciprocated in parallel with the surface side of said base plate to a horizontal direction, and the wire supplied from the guide beak to the bobbin supplied to said winding head and binding head by the bobbin lift is wound and bound, the bobbin is cut from the wire at the supplying side and can be discharged therefrom.

9. The bobbin binding device according to claim 3, wherein a supplying side of a vacant bobbin before winding at a surface side of the base plate in common with said binding device is provided with a disc-like winding head having a rotary center direction crossed at a right angle with the surface of said base plate in a rotatable manner by a motor arranged at the rear surface of said base plate and at the same time the central front side of said winding head is provided with a first bobbin chuck of a pair of opposed first and second bobbin chucks to enable the bobbin to be held at an axial center thereof in common with the rotary axis of said winding head, a chuck base table arranged in front of said base plate, the upper part of said chuck base table provided with the second bobbin chuck opposing against the first bobbin chuck of said winding head, the second bobbin chuck caused to protrude or retreat under an operation of a chuck cylinder arranged at the rear side of the second bobbin chuck and facing toward the bobbin chuck of said winding head to hold the bobbin and arranged to be rotatable in response to a rotation of said held bobbin, a location of the chuck surface of said winding head not contacted with the bobbin provided with a engaging clip having an engaging part for engaging with a middle part of the wire at its extremity end to cause said engaging part to protrude or retreat by reciprocating a pushing-out part arranged at the rear side of the chuck surface of said winding head under an operation of a cylinder installed at the rear side of said base plate to enable the wire to be held by said engaging part, a guide beak installed on a traverse table to enable the wire on a rotating bobbin to be wound in an arranged row while guiding the wire to an axial direction of the bobbin held by said first and second bobbin chucks of said winding head and reciprocating it at the wire supplying side of said base plate rather than at a position of said winding head, the winding device for the wire wound on the bobbin arranged at a discharging side of the bobbin after winding the wire, a bobbin lift reciprocatable in a vertical direction under an operation of a bobbin lift cylinder arranged at a lower side is installed through the bobbin transfer table on a lift table arranged below said chuck base table and at the same time said bobbin transfer table enables the bobbin lift to be reciprocated between said winding head and the binding head by a shaft of a lift reciprocating cylinder that can be reciprocated in parallel with the surface side of said base plate to a horizontal direction, and the wire supplied from the guide beak to the bobbin supplied to said winding head and binding head by the bobbin lift is wound and bound, the bobbin is cut from the wire at the supplying side and can be discharged therefrom.

* * * * *